US006363237B1

(12) United States Patent
Nagame et al.

(10) Patent No.: US 6,363,237 B1
(45) Date of Patent: Mar. 26, 2002

(54) UNIT FOR IMPARTING LUBRICITY TO ELECTROPHOTOGRAPHIC PHOTOCONDUCTOR, ELECTROPHOTOGRAPHIC IMAGE FORMATION APPARATUS INCLUDING THE UNIT, AND IMAGE FORMATION METHOD USING THE APPARATUS

(75) Inventors: Hiroshi Nagame; Narihito Kojima; Yohta Sakon, all of Shizuoka; Ryuta Takeichi; Akiyo Nakajima, both of Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/438,710

(22) Filed: Nov. 11, 1999

(30) Foreign Application Priority Data

| | | |
|---|---|---|
| Nov. 12, 1998 | (JP) | 10-336465 |
| Dec. 8, 1998 | (JP) | 10-348284 |
| Dec. 11, 1998 | (JP) | 10-352870 |

(51) Int. Cl.[7] ..... G03G 21/10; G03G 15/00
(52) U.S. Cl. ..... 399/343; 399/346
(58) Field of Search ..... 399/130, 343, 399/346; 310/228; 184/98, 100

(56) References Cited

U.S. PATENT DOCUMENTS

| | | | | | |
|---|---|---|---|---|---|
| 3,664,300 | A | * | 5/1972 | Joseph | 399/346 |
| 4,519,698 | A | * | 5/1985 | Kohyama et al. | 399/346 |
| 5,915,156 | A | * | 6/1999 | Kizaki et al. | 399/346 |
| 6,060,205 | A | * | 5/2000 | Takeichi et al. | 399/346 |

FOREIGN PATENT DOCUMENTS

| | | | |
|---|---|---|---|
| JP | 10-177324 | * | 6/1998 |
| JP | 11-65391 | * | 3/1999 |

* cited by examiner

*Primary Examiner*—Quana M. Grainger
(74) *Attorney, Agent, or Firm*—Cooper & Dunham LLP

(57) ABSTRACT

A lubricity-imparting unit for imparting lubricity to a surface of an electrophotographic photoconductor, which is in contact with the surface of the photoconductor, wherein at least a surface of the lubricity-imparting unit which comes into contact with the surface of the photoconductor includes a flexible lubricating material, and has a length at least capable of covering an image formation region of the electrophotographic photoconductor lengthwise. An image formation apparatus and an image formation method using this lubricity-imparting unit are described.

20 Claims, 14 Drawing Sheets

UNIT FOR IMPARTING LUBRICITY TO ELECTROPHOTOGRAPHIC PHOTOCONDUCTOR, ELECTROPHOTOGRAPHIC IMAGE FORMATION APPARATUS INCLUDING THE UNIT, AND IMAGE FORMATION METHOD USING THE APPARATUS

BACKGROUND OF THE INVENTION

1. Field of the Invention

The present invention relates to a unit for imparting lubricity to the surface of an electrophotographic photographic photoconductor for use in an image formation apparatus such as facsimile apparatus, printers, electrophotographic copying machines or the like, which is hereinafter referred to as a lubricity-imparting unit. The present invention also relates to an image formation apparatus using the lubricity-imparting unit and also to an image formation method using the image formation apparatus.

2. Discussion of Background

In the image formation apparatus such as printers, electrophotographic copying machines and facsimile apparatus, using electrophotography, there are disposed various units such as a charging unit, an exposure unit, a development unit, an image fixing unit, a cleaning unit, a charge quenching unit around a photoconductor, representative examples of which are a selenium photoconductor, a silicone photoconductor and an organic photoconductor, and image formation is carried out with successive operation of the above-mentioned units.

In the course of image formation steps, contaminating materials such as ozone and nitrogen oxides are produced in a charging step (hereinafter referred to as corona charge products) and deposited on the surface of the photoconductor, and residual toner components remain on the surface of the photoconductor after a development step. Furthermore, paper dust formed from image transfer sheets in an image transfer step, shavings of a photoconductive layer of the photoconductor, and gas components generated from the image fixing unit are also deposited on the surface of the photoconductor.

When the photoconductor is used for image formation repeatedly for an extended period of time, the above-mentioned contaminating materials build up on the surface of the photoconductor, and the surface of the photoconductor conductor becomes difficult to clean so that the cleaning performance of the photoconductor is reduced, and the abrasion of the surface of the photoconductor is promoted, with an increase in the coefficient of friction of the surface of the photoconductor. Eventually it may occur that a portion of the photoconductor with which a cleaning blade comes into contact is deformed or distorted.

The result is that improper image transfer locally takes place, the quality of images is lowered with considerable insufficiency in resolution and sharpness and the life of the photoconductor is shortened.

A corona charging method and a contact charging method are currently used in practice to charge the photoconductor. The corona charging method in fact produces a much larger quantity of corona charge products than the contact charging method does. Regardless of the quantity of the corona charge products produced, the above-mentioned problems are equally caused once the produced corona charge products build up.

Furthermore, when the coefficient of friction of the surface of the photoconductor is increased by the presence of the contaminating materials and accordingly the frictional resistance of the surface of the photoconductor is increased, the frictional pressure of the cleaning blade applied to the surface of the photoconductor is also increased. The result is that the photoconductor is caused to vibrate and makes discontinuous sharp noise called "blade's weeping". When this inappropriate state continues and develops, the blade is caught by the photoconductor during its rotation, and eventually the photoconductor is locked and the rotation thereof is stopped, so that the photoconductive layer of the photoconductor is further abraded.

However, the formation of such contaminating materials is unavoidable when the electrophotographic image formation process is carried out.

Generally, photoconductors for use in an electrophotographic image formation apparatus originally have a high coefficient of friction, in particular, when they have not been used yet and brand-new. Therefore, if image formation is repeated without taking any step for reducing the coefficient of friction of such a brand-new photoconductor, the above-mentioned contaminating materials further increase the coefficient of friction of the surface of the photoconductor and inevitably bring about the above-mentioned problems.

Therefore it is desired that there come out a technique that makes it possible to change the surface of the photoconductor to such a surface that the above-mentioned contaminating materials can be easily eliminated therefrom, and are difficult to be deposited thereon.

As one of such techniques, there has been proposed a method of coating a lubricant on the surface of the photoconductor to reduce the coefficient of friction of the surface of the photoconductor and also to improve the abrasive resistance of the surface of the photoconductor.

For instance, in Japanese Laid-Open Patent Application 56-113183, there is proposed a method of continuously applying a lubricant to the surface of the photoconductor by rotating a pouch made of a porous cloth in which a powder-like lubricant is contained or on an external surface for which the powder-like lubricant is deposited, in contact with the surface of the photoconductor, whereby the frictional resistance between the blade and the surface of the photoconductor is reduced.

When the powder-like lubricant is applied from such a rotating member as mentioned above, it is very likely that the powder-like lubricant is scattered to pollute the neighboring place of the photoconductor. Furthermore, it is very difficult to control the amount of the powder-like like lubricant to coat. It is also difficult to reduce the coefficient of friction of the surface of the photoconductor by merely coating the powder-like lubricant thereon, so that it is necessary to form a thin layer of the lubricant on the surface of the photo-conductor. However, when the coated amount varies, the coefficient of friction of the surface of the photoconductor also varies from place to place, so that the desired effect is difficult to obtain.

In Japanese Laid-Open Patent Application 3-269478, there is proposed a method of coating a lubricant which can be formed into a thin layer, such as magnesium silicate or zinc stearate, in the form of a thin layer on a top portion of the cleaning blade in order to prevent the blade from chattering or being turned over or torn up.

This method is effective. However, if the lubricant is not supplied to the coated layer for a long period of time while in use, the lubricating effect of the coated layer will not last. Once the frictional resistance between the cleaning blade and the surface of the photoconductor is increased, a noise with high frequency is generated, and eventually it becomes highly possible that the desired operation cannot be continued any longer. In particular, when a photoconductor composed of a resin for which coefficient of friction increases is used, the above-mentioned noise with high frequency is apt to be generated, so that it may occur the rotation of the photoconductor is stopped and the image formation apparatus is damaged.

In Japanese Laid-Open Patent Application 8-202226, there is proposed an image formation apparatus provided with a cleaning section in which there is disposed a device for applying a lubricant to a brush and then applying a controlled amount of the lubricant from the brush to the surface of the photoconductor.

In Japanese Laid-Open Patent Application No. 8-3052233, there is proposed an image formation apparatus provided with a control unit for detecting a toner image formed on an image bearing member and for coating a lubricant on the surface of the image bearing member in accordance with a reference value for the detection.

Furthermore, in Japanese Laid-Open Patent Application No. 6-342236, there is proposed an image formation apparatus provided with a unit for applying a lubricant to a charging roller for which line speed is made different from the rotation speed of the photoconductor, and for applying the lubricant to the photoconductor via the charging roller. This image formation apparatus is directed to the achievement of the uniform coating of the lubricant by changing the above-mentioned line speed of the charging roller.

The above-mentioned conventional problems, however, have not yet been sufficiently solved even by the above-mentioned proposals.

One of the reasons for this is that the above proposed lubricant coating methods themselves cause the above-mentioned problems. In the above proposals, it is tried to form a uniform coating layer of the lubricant by controlling the coating amount of the lubricant. However the results are not satisfactory since a uniform, thin coating layer of the lubricant is not obtained in the entire image formation area of the photoconductor by the above proposed methods. The thicker the coating layer of the lubricant, the more the coating layer catches the contaminating materials and the more slippery the coating layer becomes, so that there occurs the problem that the cleaning blade does not perform its cleaning function properly.

Even if the lubricant is coated on the surface of the photoconductor, a large number of copies will have to be made by the image formation apparatus before the coefficient of friction of the surface of the photo-conductor reaches a desired low value, and even when the coefficient of friction reaches the desired value, the value is changed as the number of copies made is increased. Thus, this method is not suitable for obtaining any of an immediate effect and a continued effect, so that the desired object cannot be attained by this method.

In addition to the problem concerning the coating method of the lubricant, the lubricant itself has a problem. In the above proposals, zinc stearate is mainly used as the lubricant. As a matter of fact, zinc stearate has excellent lubricity and therefore is suitable for obtaining abrasion resistance. However, zinc stearate has excessively high adherability to the surface of the photoconductor, so that, for example, once zinc stearate adheres to the surface of the photoconductor, the zinc stearate takes in the corona charge products and toner particles, and such materials eventually build in the zinc stearate. As a result, not only a significant reduction in the scraping effect of the cleaning blade, but also a significant local reduction in image quality is caused, and uniform coating of zinc stearate is also hindered.

In short, there has not yet been proposed a method of coating the lubricant on the surface of the photoconductor, which is capable of forming a uniform and thin coating layer of the lubricant on the surface of the photoconductor which is also capable of reducing the coefficient of friction of the surface of the photoconductor immediately after the coating, that is, when about 50 to 100 copies have been made with image formation after the coating layer is formed, and which is capable of maintaining the reduced coefficient of friction without any change even when the image formation is performed repeatedly by making a number of copies.

SUMMARY OF THE INVENTION

It is therefore a first object of the present invention to provide a lubricity-imparting unit for imparting lubricity to the surface of an electrophotographic photoconductor by coating a lubricant on the surface thereof in order to obtain excellent image quality in a stable manner even when the electrophotographic photoconductor is used repeatedly for image formation for an extended period of time, which lubricity-imparting unit is also capable of coating a uniform and thin layer of the lubricant on the surface of the photoconductor, with an immediate effect for reducing the coefficient of friction of the surface of the photoconductor, and also with a continued effect of maintaining the reduced coefficient of friction, and which lubricity-imparting unit is also capable of reducing the coefficient of friction of the surface of the photoconductor, without generating abnormal noise such as the noise called "blade's weeping" during the formation of images.

A second object of the present invention is to provide an image formation apparatus using the above-mentioned lubricity-imparting unit.

A third object of the present invention is to provide a method of image formation, using the above-mentioned image formation apparatus in which the above-mentioned lubricity-imparting unit is employed.

The first object of the present invention can be achieved by a lubricity-imparting unit which imparts lubricity to a surface of an electrophotographic photoconductor by being disposed in contact with the surface of the electrophotographic photoconductor, at least a surface of the lubricity-imparting unit which comes into contact with the surface of the electrophotographic photoconductor comprising a flexible lubricating material and having a length at least capable of covering an image formation region of the electrophotographic photoconductor lengthwise.

In the above lubricity-imparting unit of the present invention, the flexible lubricating material may be either a film-shaped material or an elastic structure.

The lubricity-imparting unit of the present invention may further comprise an elastic member which is built in the flexible lubricating material.

It is preferable that the flexible lubricating material comprise a fluoroplastic.

It is also preferable that the flexible lubricating material have a thickness of 50 to 500 $\mu$m.

The lubricity-imparting unit may further comprise an elastic member which is built in the lubricity-imparting unit, with the lubricity-imparting unit having such a structure that is fixed to a support, optionally with the lubricity-imparting unit further being held between the support and a holding plate.

In the lubricity-imparting unit of the present invention, it is preferable that a portion of the flexible lubricating material, which comes into contact with the surface of the electrophotographic photoconductor, be lined with a liner, In the lubricity-imparting unit of the present invention, a portion of the flexible lubricating material, which comes into contact with the surface of the electrophotographic photoconductor, may be marked on an inside of the portion with a marker for judging an abraded state of the flexible lubricating material.

The second object of the present invention can be achieved by an electrophotographic image formation apparatus comprising (a) an electrophotographic photoconductor, (b) a charging unit, (c) an exposure unit, (d) a development unit, an image transfer unit, and (e) a cleaning unit which are disposed around the electrophotographic photoconductor, and (f) a lubricity-imparting unit which imparts lubricity to a surface of the electrophotographic photoconductor by being disposed in contact with the surface of the electrophotographic photo-conductor, at least a surface of the lubricity-imparting unit which comes into contact with the surface of the electrophotographic photoconductor comprising a flexible lubricating material, and having a length at least capable of covering an image formation region of the electrophotographic photoconductor lengthwise.

In the above electrophotographic image formation apparatus, the flexible lubricating material may be either a film-shaped material or an elastic structure.

In the electrophotographic image formation apparatus, an elastic member may be built in the flexible lubricating material.

It is preferable that the flexible lubricating material comprise a fluoroplastic.

It is also preferable that the flexible lubricating material have a thickness of 50 to 500 $\mu$m.

In the electrophotographic image formation apparatus, an elastic member may be built in the lubricity-imparting unit, with the lubricity-imparting unit having such a structure that is fixed to a support, optionally with the lubricity-imparting unit further being held between the support and a holding plate.

Furthermore, in the electrophotographic image formation apparatus, it is preferable that a portion of the flexible lubricating material, which comes into contact with the surface of the electrophotographic photoconductor, be lined with a liner.

In the electrophotographic image formation apparatus, a portion of the flexible lubricating material, which comes into contact with the surface of the electrophotographic photoconductor, may be marked on an inside of the portion with a marker for judging an abraded state of the flexible lubricating material.

In the electrophotographic image formation apparatus, it is preferable that the lubricity-imparting unit be disposed between the cleaning unit and the charging unit.

In the electrophotographic image formation apparatus, an auxiliary cleaning unit may be disposed between the lubricity-imparting unit and the cleaning unit.

The third object of the present invention can be achieved by an image formation method of forming images, using an electrophotographic image formation apparatus comprising (a) an electrophotographic photoconductor, (b) a charging unit, (c) an exposure unit, (d) a development unit, an image transfer unit, and (e) a cleaning unit which are disposed around the electrophotographic photoconductor, and (f) a lubricity-imparting unit which imparts lubricity to a surface of the electrophotographic photoconductor by being disposed in contact with the surface of the electrophotographic photo-conductor, at least a surface of the lubricity-Imparting unit which comes into contact with the surface of the electrophotographic photoconductor comprising a flexible lubricating material, and having a length at least capable of covering an image formation region of the electrophotographic photoconductor lengthwise, wherein an image is formed with the lubricity-imparting unit being constantly set in contact with the surface of the electrophotographic photoconductor or being intermittently brought into contact with the surface of the electrophotographic photoconductor.

In the above image formation method, it is preferable that the lubricity-imparting unit in contact with the surface of the electrophotographic photoconductor form a nip of 0.2 mm or more therebetween.

In the image formation method of the present invention, it is preferable that the surface of the electrophotographic photoconductor have a coefficient of friction of 0.4 or less when the lubricity-imparting unit comes into contact with the surface of the electrophotographic photoconductor or after the image has been formed. It is also preferable that in the image formation method of the present invention, the cleaning unit comprise a cleaning blade for cleaning the surface of the electrophotographic photoconductor, and a lubricant be coated on at least one portion of (1) a top end portion of the cleaning blade, (2) a portion around the top end portion of the cleaning blade, or (3) a portion of the surface of the electrophotographic photoconductor near the cleaning blade, before the electrophotographic image formation apparatus is initiated to be brought into operation for forming the image.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 5(*b*) is a schematic cross-sectional view of another example of a lubricity-imparting unit of the present invention, in which the same flexible lubricating material as employed in the lubricity-imparting unit as shown in FIG. 5(*a*) is attached to a support base.

FIG. 6(*b*) is a schematic cross-sectional side view of a further example of a lubricity-imparting unit of the present invention, with the same structure as that of the lubricity-imparting unit as shown in FIG. 6(*a*) except that an elastic member is built in the bag-like swollen portion at the top portion thereof.

DESCRIPTION OF THE PREFERRED EMBODIMENTS

In the lubricity-imparting unit of the present invention, at least a surface of the lubricity-imparting unit which comes into contact with the surface of the electrophotographic photoconductor comprises a flexible lubricating material, and has a length at least capable of covering an image formation region of the electrophotographic photoconductor lengthwise.

The flexible lubricating material is such a material that is flexible and has a function of liberating a lubricant therefrom during its sliding contact with the surface of the photoconductor.

To be more specific, when the flexible lubricating material is brought into sliding contact with the surface of the photoconductor as the photoconductor is moved, the lubricant is liberated from the flexible lubricating material and lubricity is imparted to the surface of the photoconductor by the lubricant liberated from the flexible lubricating material.

The flexible lubricating material for use in the lubricity-imparting unit of the present invention is required to have such flexibility that when the flexible lubricating material is brought into contact with the surface of the photoconductor, the surface of the flexible lubricating material is deformed so as to come into close contact with the surface of the photoconductor, whereby the above-mentioned desired effect can be attained.

Furthermore, the flexible lubricating material is required to have at least such a length that covers an image formation region of the photoconductor lengthwise. This is because in order to attain the desired effect, it is required to conduct image formation with the flexible lubricating material of the lubricity-imparting unit kept in contact with the entire image formation region of the photoconductor lengthwise. If there is a portion in the surface of the image formation region of the photoconductor, with which portion the flexible lubricating material of the lubricity-imparting unit is out of contact, the obtained image quality becomes abnormal and non-uniform abrasion occurs on the surface of the photoconductor.

Figure 9:
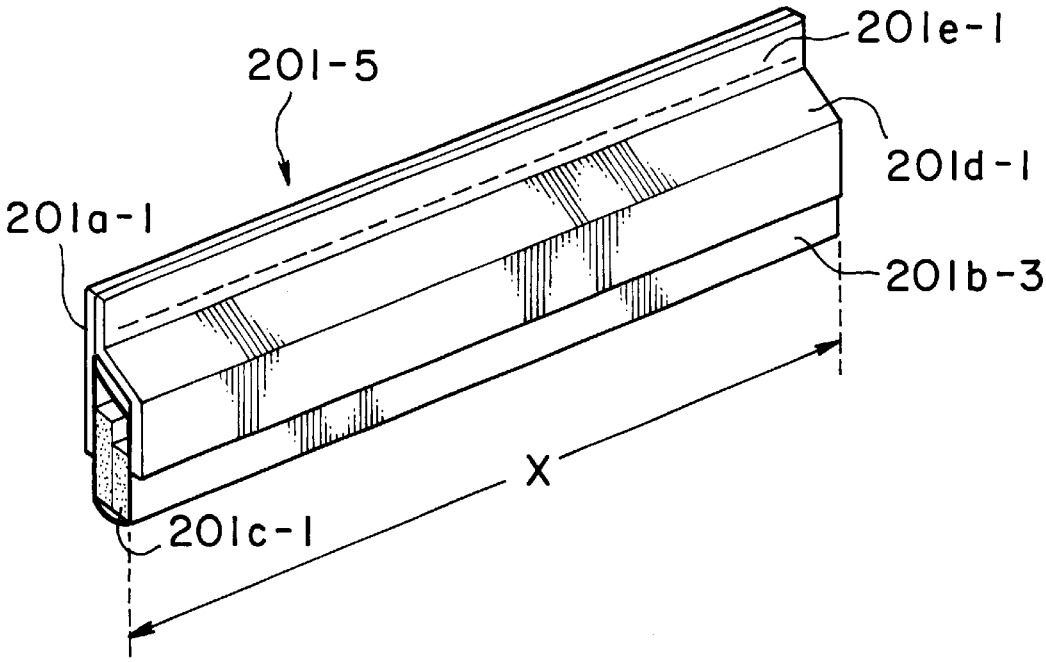
FIG. 9 is a perspective view of the lubricity-imparting unit shown in FIG. 8.

With reference to FIG. 9, a general idea of the lubricity-imparting unit of the present invention will now be explained. FIG. 9 is a perspective view of a lubricity-imparting unit 201-5 of the present invention. Reference numeral 201*b*-3 indicates a flexible lubricating material, which imparts lubricity to the surface of an electrophotographic photoconductor (not shown) with its bottom surface 201*b*-3*b* being in contact with the surface of the photoconductor in its lengthwise direction X.

Figure 15:
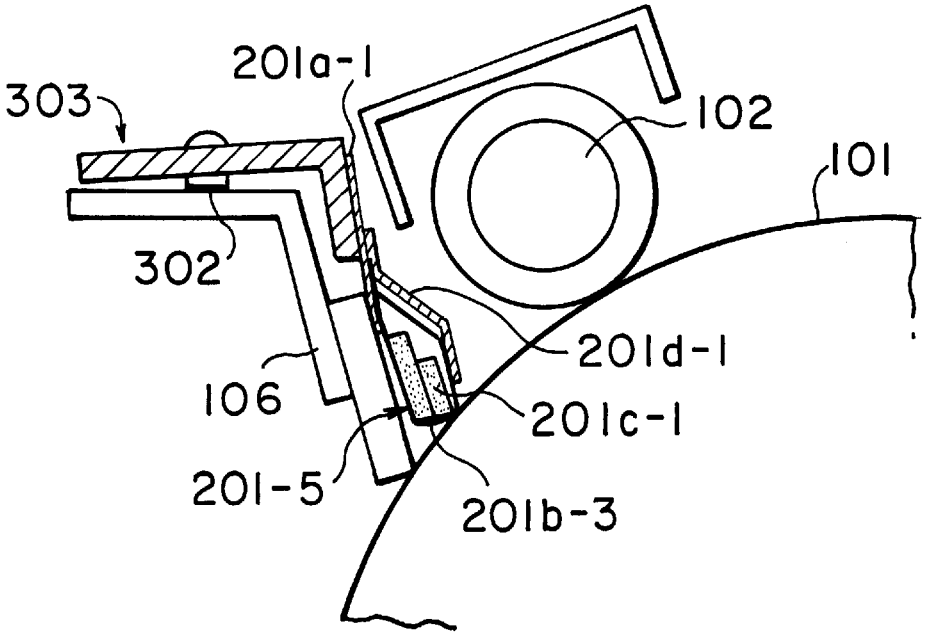
FIG. 15 is a schematic partial cross-sectional view of a further example of an image formation apparatus of the present invention in which the lubricity-imparting unit 201-5 as shown in FIG. 8 is incorporated, by attaching the lubricity-imparting unit 201-5 to a metal base portion of the blade cleaning unit 106.

In FIG. 15, there is shown the lubricity-imparting unit 201-5 of the present invention. As shown in FIG. 15, the flexible lubricating material 201*b*-3 of the lubricity-imparting unit 201-5 is in contact with the surface of an electrophotographic photoconductor 101.

The flexible lubricating material for use in the present invention may be either such a material that itself is made of a lubricating agent, which is hereinafter referred to as flexible lubricating material A, or such a material that itself is not made of a lubricating material, but is capable of imparting lubricity, with the addition of a lubricating agent thereto, which is hereinafter referred to as flexible lubricating material B.

As the above-mentioned lubricating agent, there should be selected such a lubricating agent that has no adverse effects on the electrophotographic properties of the photoconductor, with the physical properties thereof such as electric resistance and refractive index, and the chemical stability thereof taken into consideration.

This is because there may be a case where the electric resistance of the lubricating agent disturbs the state of a latent electrostatic image formed, or a case where the refractive index of the lubricating agent has adverse effects on the exposure step in the image formation due to the light scattering of the lubricating agent.

Therefore it is preferable that the lubricating agent for use in the present invention have an electric resistance of about $10^{14}$ Ω·cm or more, and a refractive index near 1.0.

Therefore, any lubricant agent which satisfies the above conditions can be employed in the present invention without any particular restrictions. However, the flexible lubricating material A, which itself is made of a lubricating agent, is preferable for use in the present invention when the productivity of the lubricity-imparting unit and the space for mounting the lubricity-imparting unit in the image formation apparatus are taken into consideration. As the flexible lubricating material A, fluoroplastic is particularly preferable for use in the present invention.

The reasons why the fluoroplastic is preferable for use in the present invention are that the fluoroplastic has particularly excellent chemical stability, and has excellent contacting performance with the surface of the photoconductor, and also has excellent transfer performance to the surface of the photoconductor, so that lubricity can be effectively imparted to the surface of the photoconductor. Furthermore, the fluoroplastic has so high electric resistance that the electrophotographic properties of the photoconductor are hardly impaired by the fluoroplastic.

There is another reason why the fluoroplastic can be effectively used in the lubricity-imparting unit of the present invention. The fluoroplastic is soft, but has almost no elasticity, so that it is considered that when the fluoroplastic comes into contact with another material and is brought into sliding contact with the material, fluorine at the top of the fluoroplastic is caused to fall off and the fluoroplastic is transferred to the material, whereby lubricity is imparted to the material with which the fluoroplastic comes into contact.

Examples of fluoroplastics for use in the present invention are polytetrafluoroethylene (PTFE)(Trademark "Teflon"), ethylene tetrafluoride-perfluoroalkylvinyl ether copolymer (PFA), polychlorotrifluoroethylene (PCTFE), tetrafluoroethylene-ethylene copolymer (ETFE), polyvinylidene fluoride (PVDF), tetrafluoroethylene-oxafluoropropylene copolymer (FEP), polychlorotrifluoroethylene (PCTFE), polytrifluorochloroethylene (PTFCE), dichlorodifluoroethylene, and polytrifluoroethylene (PTFE); and fibers made of fluoroplastics such as polyfluorocarbon and polytetrafluoroethylene. Of these fluoroplastics, polytetrafluoroethylene is a particularly effective material for use as the flexible lubricating material A.

As the lubricating agent for use in the flexible lubricating material B, any conventionally employed lubricating agents can be employed without any particular restrictions as long as they can satisfy the above-mentioned conditions.

For example, as the flexible lubricating material B, there can be employed flexible materials such as fabric, felt, sheet-shaped materials having fine holes therein, which are capable of containing any of greases such as synthetic silicone or fluorine-based lubricating greases, represented by, for example, fluorine-based grease, silicone-based grease, silicone-fluorine-based grease, or solid powder lubricants and liquid lubricants other than the above greases, or which are impregnated with such a grease or lubricant as mentioned above. However, in the case of the flexible lubricating material B, some technique is required to add the lubricant to a supporting material for the flexible lubricating material B and to coat the lubricant in the form of a uniform and thin layer on the surface of the photoconductor, using the flexible lubricating material B, so that the flexible lubricating material A is much more preferable for use in the present invention than the flexible lubricating material B. In particular, the flexible lubricating material A made of the fluoroplastic is effective.

Furthermore, it is preferable that the flexible lubricating material A be in the form of a film or sheet for use in practice, which is hereinafter collectively referred to as "film-shaped lubricating material A", in view of the facts that the production of the lubricity-imparting unit, using the film-shaped lubricating material A, is easy, and that the size of the image formation apparatus can be reduced in view of the space required for the film-shaped lubricating material A.

Furthermore, the film-shaped flexible lubricating material A can be adjusted in thickness, so that a film-shaped flexible lubricating material A with a desired thickness can be easily selected, and the film-shaped flexible lubricating material A can attain excellent contact with the surface of the photoconductor, and hardly scratches the surface of the photoconductor.

Furthermore, in order to have the lubricity-imparting unit attain closer and softer contact with the surface of the photoconductor, there can be employed therein a flexible lubricating material A with a net-work structure, a sponge-like flexible lubricating material A composed of fibers containing bubbles between the fibers, a marshmallow-like flexible lubricating material A, and a flexible lubricating material A composed of softly bundled fibers that can be split in a lengthwise direction, which is referred to as an elastically structured flexible lubricating material A.

Examples of such flexible lubricating materials A that are commercially available are "Teflon Soft Tape" (Trademark) made by Flon Industry Co., Ltd., and "NAFLON PTFE SP PACKING" (Trademark) made by Nichias Corporation.

Another method of increasing the contact performance of the lubricity-imparting unit is to use a composite structure composed of the film-shaped flexible lubricating material A and an elastic member which is disposed behind the film-shaped flexible lubricating material A, on an inner side thereof opposite to the contacting side of the film-shaped flexible lubricating material A with the surface of the photoconductor.

A composite structure with an elastic member called "sponge", "MOLTOPREN" or "foam" being built therein, serving as the above-mentioned composite structure, has excellent deformation stability and is effective for making a number of copies.

The thickness of the flexible lubricating material is an important factor for obtaining suitable contact performance with the surface of the photoconductor and appropriate stability. When the flexible lubricating material is excessively thin, the durability thereof may be insufficient, while when the flexible lubricating material is excessively thick, the contacting surface of the flexible lubricating material with the surface of the photoconductor will be hard and may damage the surface of the photoconductor. Therefore, it is preferable that the flexible lubricating material have a thickness of about 50 to 500 $\mu$m, more preferably about 100 to 300 $\mu$m.

However, the flexible lubricating material A, in particular, has the shortcomings that it is easily deformed with elongation or wrinkling when it is thin, and it is vulnerable to its sliding contact with the surface of the photoconductor, but has an advantage that its contact performance with the surface of the photoconductor is stable, so that in order to make good use of the advantage of the flexible lubricating material A, it is preferable to line the flexible lubricating material A with, for instance, an acetate film.

The flexible lubricating material can be used alone as the lubricity-imparting unit of the present invention, without being fixed to any support, for example, when the hardness of at least a fixing portion thereof for mounting the lubricity-imparting unit on the image formation apparatus is increased by using a flexible lubricating material with an appropriate property or by appropriately fabricating the flexible lubricating material.

However, in order to attain stable characteristics and operation, it is preferable to fix the flexible lubricating material to a support or form a structure in which the flexible lubricating material is held between the support and a holding plate for use in practice.

As the support, either a rein film or a metal plate can be used. For example, a film of polycarbonate resin, polyethylene terephthalate resin, acrylic resin, or vinyl chloride resin, an aluminum plate, and a stainless plate can be used. These materials can also be used for the holding plate.

The thickness of each of the support and the holding plate can be appropriately adjusted in accordance with the structure of the lubricity-imparting unit.

When the flexible lubricating material A is used for an extended period of time, problems such as elongation and breaking of the material A may occur, and such problems will bring about the lowering of image quality, local abrasion of the photoconductor, and the contamination of the photoconductor. When such problems occur, the flexible lubricating material A has to be replaced with a fresh flexible lubricating material A, but such replacement of the flexible lubricating material A should be carried out well before the above-mentioned problems occur. This can he securely carried out by placing markings indicating the replacement time inside the flexible lubricating material A in an area corresponding to the contacting portion thereof with the photoconductor.

The flexible lubricating materials A is usually translucent and white or brown in color, so that as the flexible lubricating material A is abraded and made thinner while in use, its transparency is increased and the markings placed on the inside of the flexible lubricating material A become clearly visible, so that the replacement time of the flexible lubricating material A can be timely indicated.

Representative examples of the lubricity-imparting units of the present invention will now be explained.

Figure 5A:
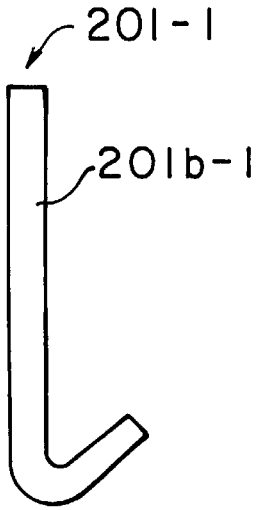
FIG. 5(*a*) is a schematic cross-sectional side view of an example of a lubricity-imparting unit of the present invention, which is made of a film-shaped fluoroplastic, serving as a flexible lubricating material.
Figure 5B:
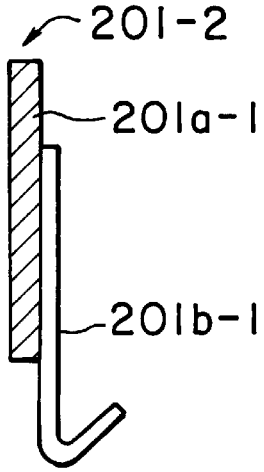

FIG. 5(*a*) is a schematic cross-sectional side view of a lubricity-imparting unit 201-1 of the present invention, which is made of a film-shaped fluoroplastic, serving as a flexible lubricating material 201*b*-1, with a thickness of 300 to 500 $\mu$m and a length corresponding to the length of an image formation region of a photoconductor 101 (not shown) in a lengthwise direction. The flexible lubricating material 201*b*-1 is bent so as to form a nip with the surface of the photoconductor 101.

FIG. 5(*b*) is a schematic cross-sectional view of a lubricity-imparting unit 201-2 of the present invention, in which the same flexible lubricating material 201*b*-1 as employed in the lubricity-imparting unit 201-1 shown in FIG. 5(*b*) is attached to a support base 201*a*-1.

The lubricity-imparting units 201-1 and 201-2 of the above-mentioned type are suitable for use in an image formation apparatus for making a relatively small number of copies of about 50,000.

As the material for the support base 201*a*-1, for instance, there can be employed a polycarbonate resin film, an acrylic resin film, a polyethylene terephthalate resin film, a Bakelite resin film, an aluminum plate and a stainless steel plate can be employed. It is preferable that the support base for use in the present invention, such as the support base 201*a*-1, have a thickness of about 200 to 1000 $\mu$m.

Figure 6A:
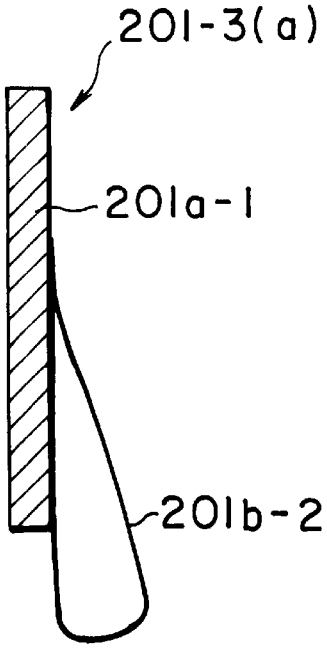
FIG. 6(*a*) is a schematic cross-sectional side view of a further example of a lubricity-imparting unit of the present invention, which is composed of a film-shaped flexible lubricating material, which is made round to form a bag-like swollen portion at the top portion thereof and is attached to a support base.
Figure 6B:
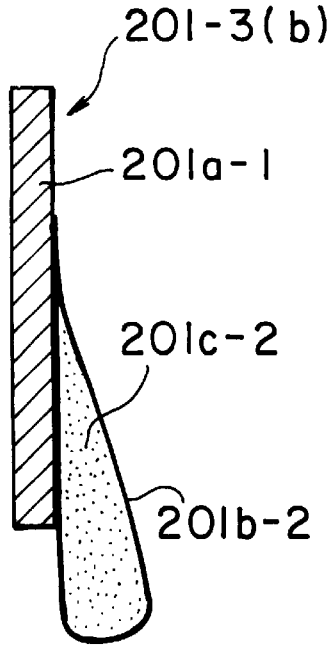

FIG. 6(*a*) is a schematic cross-sectional side view of a lubricity-imparting unit 201-3(*a*) of the present invention, which is composed of a film-shaped flexible lubricating material 201*b*-2 made of the above-mentioned flexible lubricating material A, with a thickness of 50 to 200 $\mu$m, which is folded round to form a bag-like swollen portion at the top portion thereof as shown in FIG. 6(*a*) , and is attached to the support base 201a-1

FIG. 6(*b*) is a schematic cross-sectional side view of a lubricity-imparting unit 201-3(*b*) of the present invention, with the same structure as that of the lubricity-imparting unit as shown in FIG. 6(*a*) except that an elastic member 201*c*-2 is built in the bag-like swollen portion at the top portion thereof.

Figure 13:
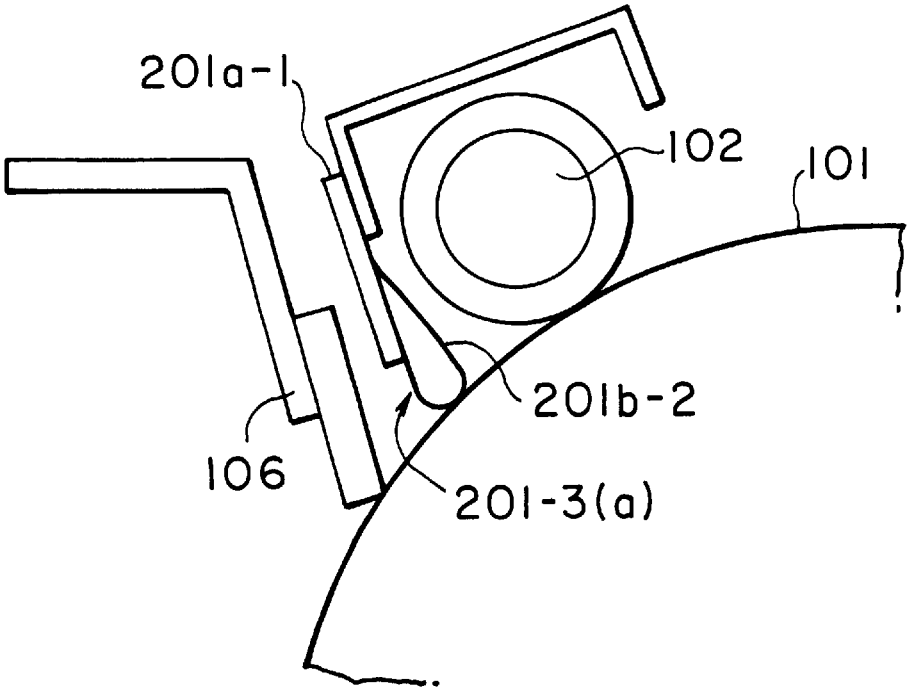
FIG. 13 is a schematic cross-sectional view of another example of the image formation apparatus in which the lubricity-imparting unit as shown in FIG. 6(*a*) is incorporated, by attaching the lubricity-imparting unit to the cover of the charging unit.

The support base 201*a*-1 serves to bring only a substantial working region of the flexible lubricating material 201*b*-2 into contact with the surface of the photoconductor, without bringing the ether region of the flexible lubricating material 201*b*-2 into contact with the surface of the photoconductor, and also to maintain the strength of the flexible lubricating material 201*b*-2. The swollen portion formed at the top round portion of the flexible lubricating material 201*b*-2 serves to bring the flexible lubricating material 201*b*-2 into soft contact with the surface of the photoconductor 101 as shown in FIG. 13.

When a film-shaped flexible lubricating material as thin as 50 $\mu$m is used, it is preferable to use the film-shaped flexible lubricating material by superimposing and bonding two of the film-shaped flexible lubricating materials, using a double-coated adhesive tape at a position away from the contacting position of the film-shaped lubricating material with the surface of the photoconductor, in view of its durability, and easiness in handling and fabrication of the lubricity-imparting unit made of the film-shaped flexible lubricating material.

Figure 7:
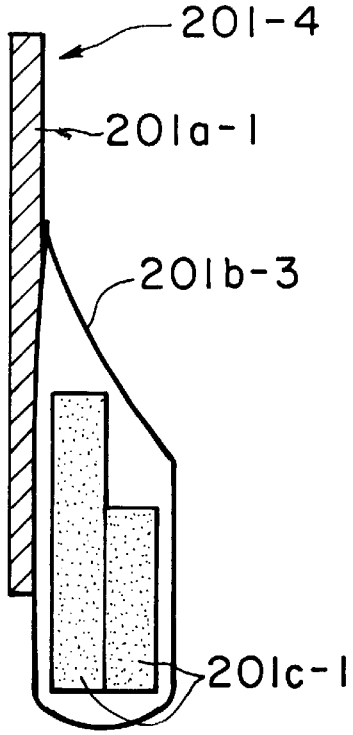
FIG. 7 is a schematic cross-sectional side view of still another example of a lubricity-imparting unit of the present invention, which is composed of a flexible lubricating material made of a fluoroplastic, in which an elastic member is built.
Figure 8:
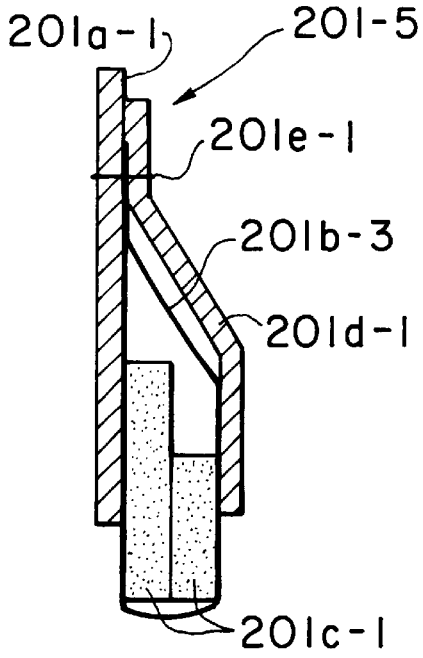
FIG. 8 is a schematic cross-sectional side view of a further example of a lubricity-imparting unit of the present invention, which has the same structure as that of the lubricity-imparting unit as shown in FIG. 7 except that a holding plate is additionally provided on a front side of the lubricity-imparting unit, whereby the durability of the structure of the lubricity-imparting unit as shown in FIG. 7 is enhanced.

FIG. 7 is a schematic cross-sectional side view of a lubricity-imparting unit 201-4 of the present invention, which is composed of a flexible lubricating material 201*b*-3 made of a fluoroplastic, in which an elastic member 201*c*-1 is built. The flexible lubricating material 201*b*-3 is bonded to the support base 201*a*-1, using a commercially available strong double-coated adhesive tape such as double-coated adhesive tapes made by Nichiban Co., Ltd., "ST416P" (Trademark) made by Sumitomo 3M Limited, and "Nitto Tape" (Trademark) made by Nitto Denko Corporation. The flexible lubricating material 201*b*-3 can be bonded to the support base 201*a*-1, using any of the above-mentioned double-coated adhesive tapes, and the bonding can be reinforced, for instance, by using a caulking member 201*e*-1 such as a nail of a stapler as shown in FIG. 8.

It is preferable to use as the elastic member 201*c*-1 a member which is soft and has high tensile strength and minimal compressive residual strain. This is because such a member as mentioned above can minimize the deterioration of the contacting performance of the flexible lubricating material 201*b*-3 with the surface of the photoconductor as caused by the deformation of the flexible lubricating material 201*b*-3 while in contact with the surface of the photoconductor for an extended period of time, and also can maintain uniform contact of the flexible lubricating material 201*b*-3 with the surface of the photoconductor.

A urethane foam "PORON LE-20" (Trademark), made by INOAC CORPORATION, with the characteristics (density: 0.2 g/cm$^2$, tensile strength: 3.1 kg cm$^2$, elongation: 150%, compressive residual strain: 5.9%) is one of good examples of the elastic materials for the elastic member 201*c*-1. Urethane resin foamed materials which are generally called "sponge" or "MOLTOPREN", such as HR-80, EGR-2, SM-55 and ECT, made by INOAC CORPORATION, can also be used as the materials for the elastic member 201*c*-1.

The thickness of the elastic member 201*c*-1 should be adjusted in accordance with the space for incorporation of the elastic member 201*c*-1 within the flexible lubricating material 201*b*-3. However, normally an elastic member with a thickness of 2 to 5 mm will be sufficiently suitable for use in practice. In case an elastic member with a thickness of 2 to 3 mm is used, one or two elastic members should be piled one above the other, or the elastic member is folded when used. An elastic member with a thickness of 5 mm can be used as a single sheet without either being folded or being piled.

It is not always necessary that the elastic member be in the shape of a sheet. The elastic member may also be in the shape of a rod, or in the shape of a balloon.

It is preferable that a film-shaped flexible lubricating material have a thickness of about 50 to 100 $\mu$m.

The lubricity-imparting units 201-3(*a*), 201-3(*b*) and 201-4 of the above-mentioned type shown in FIGS. 6(*a*) and 6(*b*) and FIG. 7 are suitable for use in an image formation apparatus for making about 50,000 or more copies.

FIG. 8 is a schematic cross-sectional side view of a lubricity-imparting unit 201-5 of the present invention, which has the same structure as that of the lubricity-imparting unit 201-4 as shown in FIG. 7 except that a holding plate 201*d*-1 is additionally provided on a front side of the lubricity-imparting unit 201-4, whereby the durability of the structure of the lubricity-imparting unit 201-4 as shown in FIG. 7 is enhanced.

When the above lubricity-imparting unit 201-4 as shown in FIG. 7 is used over an extended period of time, it may occur that the contact of the flexible lubricating material 201*b*-3 with the surface of the photoconductor becomes unstable due to the deformation of the elastic member 201*c*-1 and the coefficient of friction of the surface of the photoconductor is locally increased. In order to prevent the above problems, the holding plate 201*d*-1 is additionally provided in the lubricity-imparting unit 201-5 as shown in FIG. 8.

By the provision of the holding plate 201*d*-1, stable image formation with high image quality and significant reduction in the abrasion of the surface of the photoconductor can be guaranteed over a long period of time, The flexible lubricating material 201*b*-3 is held between the support base 201*a*-1 and the holding plate 201*d*-1 by using a double-coated adhesive tape. The holding stability of the flexible lubricating material 201*b*-3 can be further improved when a caulking member 201*e*-1, for example, a nail of a stapler, is used as shown in FIG. 8.

With respect to the thickness of the film-shaped flexible lubricating material 201*b*-3, a thickness of about 100 $\mu$m is sufficient for use in the above lubricity-imparting unit 201-5 of the present invention. When the thickness is increased to about 300 $\mu$m, the elastic member 201*c*-2 cannot exert its elasticity on the film-shaped flexible lubricating material 201*b*-3 as expected.

As the material for the holding plate 201*d*-1, a polycarbonate resin film, an acrylic resin film, or a polyethylene terephthalate resin film with a thickness of about 200 to 500 $\mu$m can be employed. Normally a polyethylene terephthalate resin film or a polycarbonate resin film with a thickness of about 200 to 300 $\mu$m may be used.

FIG. 9 is a perspective view of the lubricity-imparting unit 201-5 shown in FIG. 8. It is required that at shortest the flexible lubricating material 201*b*-3 have such a length that covers the image formation region of the photoconductor in a lengthwise direction as shown by X.

Figure 10:
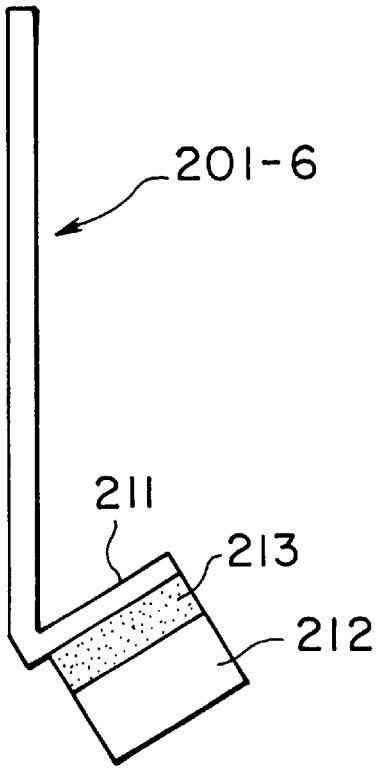
FIG. 10 is a schematic cross-sectional side view of a further example of a lubricity-imparting unit of the present invention, in which as the flexible lubricating material is used an elastic structure attached to a support base.

FIG. 10 is a schematic cross-sectional side view of a lubricity-imparting unit 201-6 of the present invention, in which as the flexible lubricating material is used an elastic structure 212 attached to a support base 211 through an elastic member 213 which is called "sponge", "MOLTOPREN" or "foam". The "foam" has higher density than those of "sponge" and "MOLTOPREN". In the lubricity-imparting unit 201-6, the elastic structure 212, serving as the flexible lubricating material, may also be directly attached to the support base 211 without through the elastic member 213.

The elastic structure 212 is a structure having the same excellent restoring force and elasticity as those of the "sponge" and "MOLTOPREN".

Figure 11:
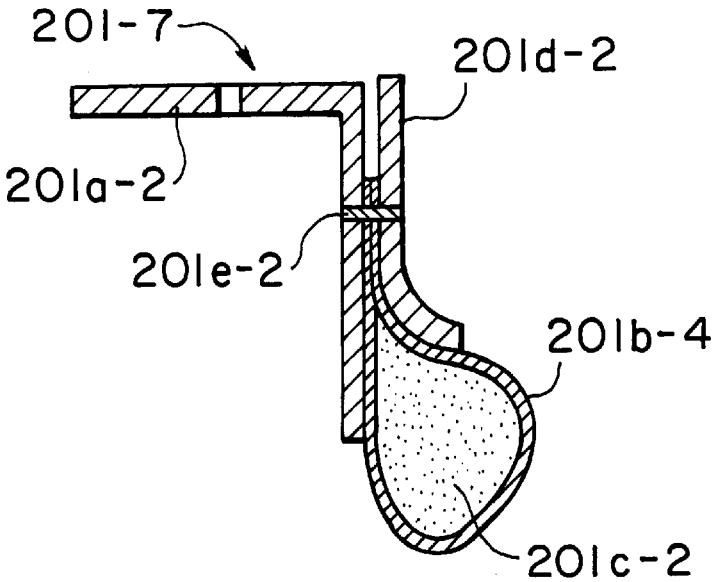
FIG. 11 is a schematic cross-sectional side view of a further example of a lubricity-imparting unit of the present invention, which can be fixed to a metal base portion of a blade cleaning unit (not shown), using a screw through a support base.

FIG. 11 is a schematic cross-sectional side view of a lubricity-imparting unit 201-7 of the present invention, which can be fixed to a metal base portion of a blade cleaning unit (not shown), using a screw through a support base 201*a*-2. In the figure, reference numeral 201*b*-4 indicates a flexible lubricating material; reference numeral 201*c*-2, an elastic material; reference numeral 201*d*-2, a holding plate; and reference numeral 201*e*-2, a caulking member. As the material for the support base 201*a*-2, an about 250 $\mu$m thick film made of polycarbonate resin or polyethylene terephthalate resin, and an about 0.1 to 0.2 mm thick aluminum or stainless steel plate can be employed.

How the lubricity-imparting unit of the present invention is used in an electrophotographic image formation process will now be explained.

To begin with, with reference to FIG. 1, the outline of the electrophotographic image formation process will be explained.

The surface of the electrophotographic photoconductor 101 is charged with a charging unit 102, which is a contact charging unit. The polarity of the charging differs depending upon the material of the photoconductor 101 employed. In organic photoconductors, which are currently mainly used, there are two types, a positive charging type and a negative charging type.

With respect to the photoconductor to be used with the lubricity-imparting unit of the present invention, there is no particular restriction on the charging polarity.

FIGS. 2(*a*) to 2(*d*) schematically show a cross-sectional view of each of representative photoconductors currently used, in particular, showing the layer structure thereof.

FIG. 2(*a*) is a schematic cross-sectional view of a single-layer type photoconductor comprising an electroconductive support 1, an undercoat layer 2 formed on the electroconductive support 1, and a photoconductive layer 5-1 formed on the undercoat layer 2, which photoconductive layer 5-1 integrally comprises a charge transport material and a charge generation material.

FIG. 2(*b*) is a schematic cross-sectional view of a function-separated type photoconductor comprising an electroconductive support 1 and a photoconductive layer 5-2 formed on the electroconductive support 1, which photoconductive layer 5-2 comprises a charge generation layer 3 and a charge transport layer 4 formed on the charge generation layer 3.

FIG. 2(*c*) is a schematic cross-sectional view of another function-separated type photoconductor, which has the same structure as that of the function-separated type photoconductor shown in FIG. 2(*b*) except that an undercoat layer 2 is interposed between the electroconductive support 1 and the charge generation layer 3 of the photoconductive layer 5-2.

FIG. 2(*d*) is a schematic cross-sectional view of a further function-separated type photoconductor which has the same structure as that of the function-separated type photoconductor shown in FIG. 2(*c*) except that a protective layer 6 is provided on the charge transport layer 4 of the photoconductive layer 5-2.

For positive charging, the single-layer type photoconductor with the structure as shown in FIG. 2(*a*) is preferably employed, while for negative charging, the function-separated type photoconductors with the structures as shown in FIGS. 2(*b*) to 2(*d*) are preferably employed.

A main reason why the charge transport layer 4 is provided on the charge generation layer 3 is that the life of the photoconductor can be lengthened by this layer provision structure. When the charge generation layer 3 is provided on the charge transport layer 4, in most cases, a protective is necessary for the charge generation layer 3 in order to lengthen the life of the photoconductor.

The function-separated type photoconductor as shown in FIG. 2(*d*) has a better abrasion resistance in comparison with the function-separated type photoconductor as shown in FIG. 2(*c*) because of the provision of the protective layer 6 on the charge transport layer 4 thereof.

With reference back to FIG. 1, after the surface of the photoconductor 101 is positively or negatively charged by the charging unit 102, the surface of the photoconductor 101 is exposed by an image exposure system 103 to a light image corresponding to an original image to be copied, whereby a latent electrostatic image corresponding to the original image is formed on the surface of the photoconductor 101.

The thus formed latent electrostatic image is developed with a developer to a toner image on the photoconductor 101 by a development unit 104. The thus developed toner image formed on the photoconductor 101 is then transferred to a copy sheet 109 by an image transfer unit 105 and fixed to the copy sheet 109 by an image fixing unit 108, whereby a hard copy can be obtained.

After the image transfer, the photoconductor 101 is then cleaned by a cleaning unit 106, so that a residual toner is removed from the surface of the photoconductor 101, and the surface of the photoconductor 101 is then subjected to charge quenching by a quenching unit 107, usually using a red light beam, to remove residual charges from the surface of the photoconductor 101, whereby a series of copying processes are finished.

The lubricity-imparting unit of the present invention can be placed at any position when there is a space available for the lubricity-imparting unit. However, in order to operate the lubricity-imparting unit effectively, it is most preferable to dispose the lubricity-imparting unit at a place between the cleaning unit 106 and the charging unit 102, where the lubricity-imparting unit is not affected at all by any of the copying processes.

Figure 1:
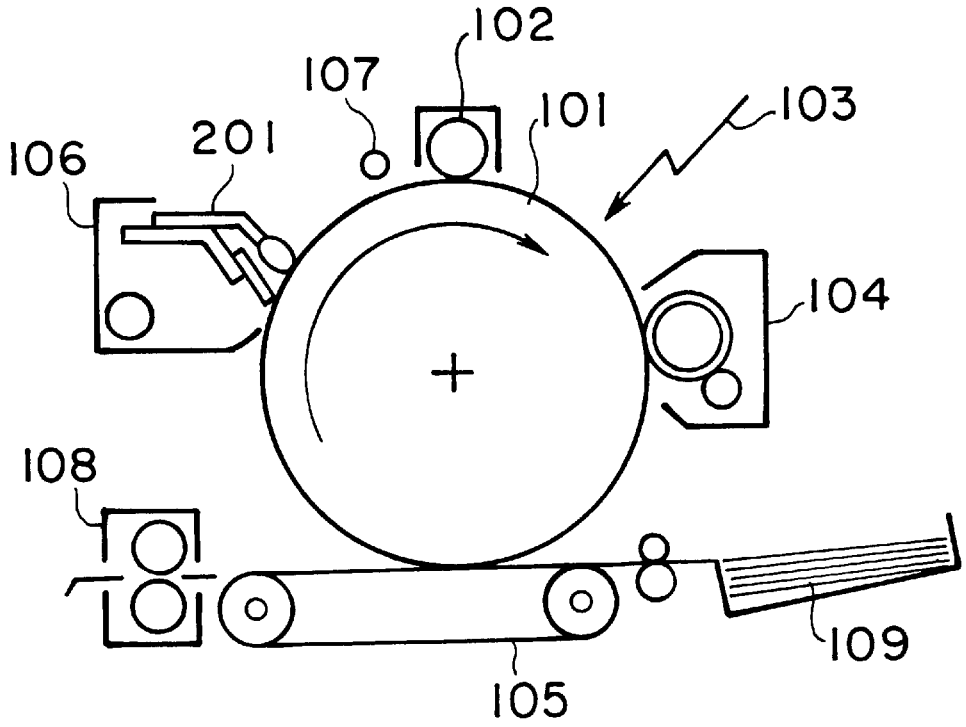
FIG. 1 is a schematic diagram in explanation of an electrophotographic image formation method of the present invention.
Figure 2A:
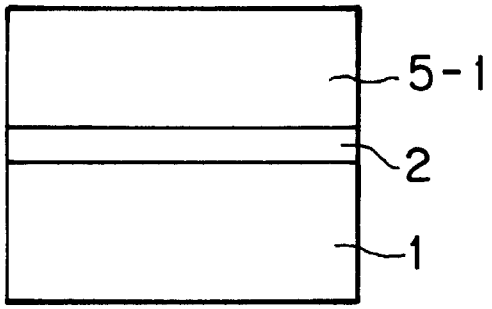
FIGS. 2(*a*) to 2(*d*) are schematic cross-sectional views of electrophotographic photoconductors for use in the present invention in explanation of the layer structures thereof.
Figure 2B:
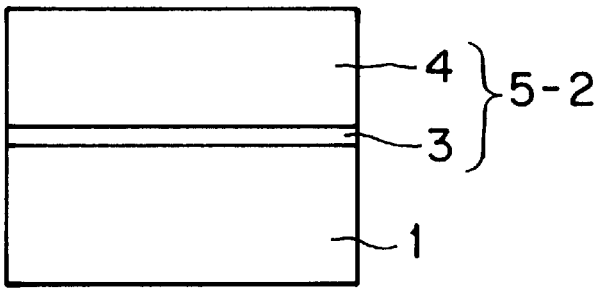
Figure 2C:
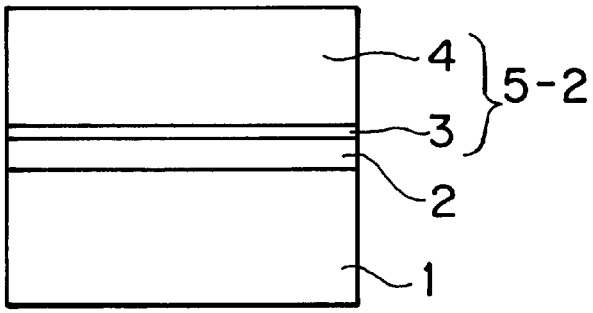
Figure 2D:
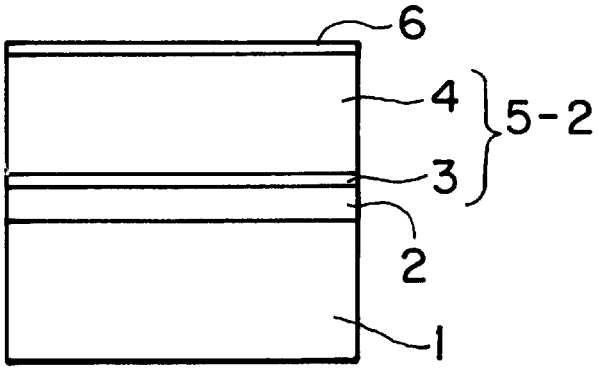

In the electrophotographic image formation apparatus shown in FIG. 1, a lubricity-imparting unit 201 of the present invention is disposed between the cleaning unit 106 and the charging unit 102 as a preferable embodiment.

Even if the lubricity-imparting unit 201 is disposed at a place other than the place between the cleaning unit 106 and the charging unit 102, the lubricity-imparting unit 201 can fulfill its function.

For instance, in the case where the lubricity-imparting unit 201 is disposed between the development unit 104 and the image, transfer unit 105, after the lubricating agent is applied to the surface of the photoconductor 101 by bring the lubricity-imparting unit 201 into contact with the surface of the photoconductor 101, the lubricity-imparting unit 201 is maintained out of contact with the surface of the photoconductor 101 until all the copying steps are finished. Otherwise, the lubricity-imparting unit 201 will come into contact with the surface of the photoconductor 101 and destroy the developed toner images.

In this case, when a number of copies are made from a single original, the lubricant originally transferred to the photoconductor 101 from the lubricity-imparting unit 201 is gradually removed by a cleaning blade or other members as the copying operation proceeds, and the film of the lubricant formed on the surface of the photoconductor 101 will eventually become non-uniform in thickness, and the desired effect to be attained by the lubricity-imparting unit 201 cannot be sufficiently obtained, although when the number of copies to be made from one original is several, such a problem will not become serious.

In the case where the lubricity-imparting unit 201 is disposed between the cleaning unit 106 and the charging unit 102, the lubricity-imparting unit 201 can be constantly maintained in contact with the surface of the photoconductor 101 or can be intermittently brought into contact with the surface of the photoconductor 101.

In the intermittent contact, the lubricity-imparting unit 201 is kept in contact with the surface of the photoconductor 101 for a certain period of time, and then continuously separated away from the surface of the photoconductor 101 for a certain period of time, and these steps are repeated. In the case where this intermittent contact method is adopted, the abrasion of the surface of the photoconductor 101 is slightly larger than in the case where the lubricity-imparting unit 201 is maintained in contact with the surface of the photoconductor 101 for a certain period of time, but the image quality obtained is more stable than in the latter case.

Figure 3:
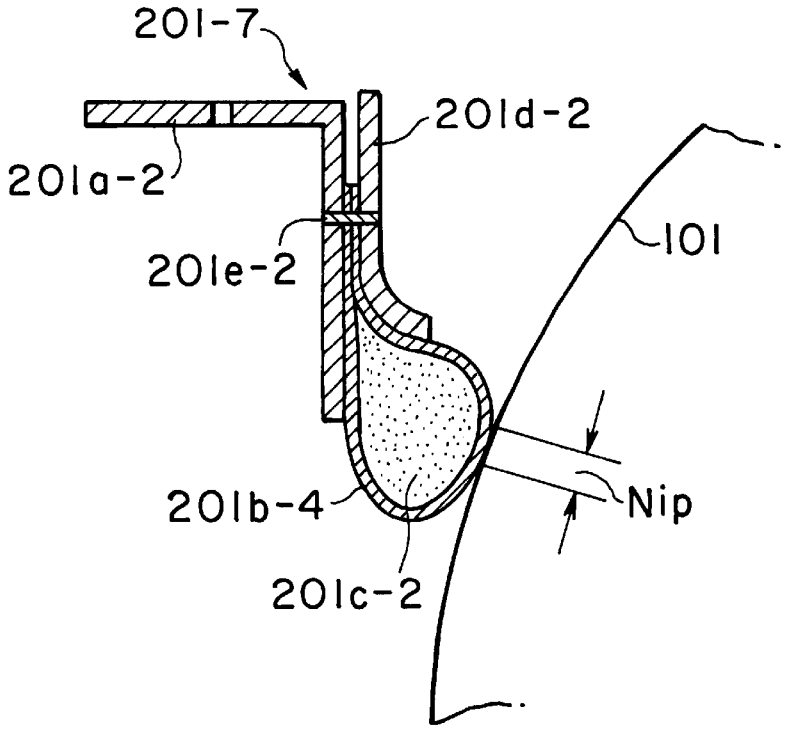
FIG. 3 is a schematic cross-sectional view of an example of a lubricity-imparting unit of the present invention in contact with the surface of an electrophotographic photoconductor in explanation of a nip between the lubricity-imparting unit and the surface of the photoconductor.
Figure 4:
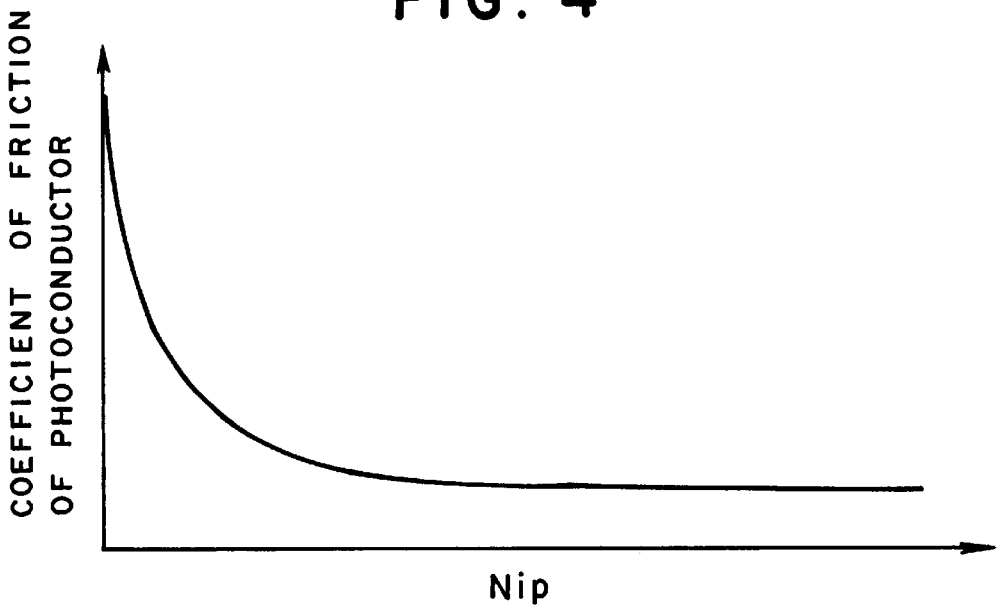
FIG. 4 is a graph in explanation of the relationship between the nip and the coefficient of friction of the surface of the photoconductor for use in the present invention.

With reference to FIGS. 3 and 4, a contact width of a contact region between the flexible lubricating material of the lubricity-imparting unit of the present invention and the surface of the photoconductor in a lengthwise direction, which contact width is referred to as the nip, will now be explained. The nip is a very important factor for imparting lubricity to the photoconductor, and also for maintaining the coefficient of friction of the surface of the photoconductor in an appropriate range.

In FIG. 3, reference numeral 201-7 indicates a lubricity-imparting unit of the present invention, which is composed of a flexible lubricating material 201*b*-4, a support base 201*a*-2, a holding plate 201*d*-2, and a caulking member 201*e*-2. An elastic material 201*c*-2 may be disposed within a bag portion formed by the flexible lubricating material 201*d*-2 when necessary. When the flexible lubricating material 201*b*-4 is brought into sliding contact with the surface of the photoconductor 101, fine particles of a lubricant (not shown) are transferred to the surface of the photoconductor 101 from the flexible lubricating material 201*b*-4. The lubrication of the surface of the photoconductor 101 at this moment depends upon the nip.

As shown in FIG. 4, as the nip becomes nearly zero so that the flexible lubricating material 201*b*-4 is nearly in line contact with the surface of the photoconductor 101, the flexible lubricating material 201*b*-4 exerts almost no lubricating performance on the surface of the photoconductor 101, while as the nip is increased, the lubricating performance exerted by the flexible lubricating material 201*b*-4 is increased and eventually reaches a constant level.

The nip basically signifies a total time period in which the flexible lubricating material is in contact with the surface of the photoconductor, and depends upon the quality of the flexible lubricating material, and also upon the state and properties of the surface of the photoconductor. It is preferable that the nip be 0.2 mm or more, although the nip is not limited to such a value.

However, when the nip is excessively large, the contact time is excessively extended and the coefficient of friction of the photoconductor is reduced too much, so that the cleaning effect is not obtained, resulting in causing the reduction in image quality. Therefore, it is preferable that the nip be in the range of 0.5 to 1.5 mm, more preferably in the range of 0.8 to 1.1 mm.

The nip also depends upon the contact pressure of the flexible lubricating material applied to the surface of the photoconductor 101. For instance, when the contact pressure is excessively large, the nip cannot be adjusted and the surface of the photoconductor 101 will be scratched. Therefore it is desirable that the contact pressure be appropriately adjusted to obtain an optimum nip.

When a photoconductor with a small diameter, such as a diameter of 24 mm or 30 mm, is used, a large nip cannot be secured. However, when a photoconductor with a large diameter, such as a diameter of 80 mm or 100 mm, is used, a sufficiently large nip can be secured, which is favorable for conducting high speed image formation, and an allowable range of the contact pressure can be enlarged. Therefore, it is also necessary to set an appropriate nip in accordance with the diameter of the photoconductor.

It is also necessary that the contact pressure be set in accordance with the lubricity-imparting unit employed in order to operate the lubricity-imparting unit properly. When the contact pressure is excessively high, the lubricity-imparting unit mechanically damages the photoconductor, while when the contact pressure is excessively low, the flexible lubricating material does not come into uniform contact with the surface of the photoconductor, so that the abrasion of the photo-conductive layer of the photoconductor becomes non-uniform and the image quality obtained also becomes non-uniform. The contact pressure depends upon the shape and the quality of the flexible lubricating material used in the lubricity-imparting unit and therefore is defined as follows in the present invention.

A high quality paper in the shape of a belt with a length of 100 mm, a width of 30 mm, and a thickness of 85 $\mu$m is inserted between the photoconductor and the flexible lubricating material of the lubricity-imparting unit, and is then pulled, using a digital force gauge. A maximum value indicated by a pointer of the digital force gauge in the scale thereof, when the high quality paper belt is pulled, is defined as the contact pressure (gr).

The value of the coefficient of friction of the surface of the photoconductor, which is obtained when the flexible lubricating material of the lubricity-imparting unit is brought into contact with the surface at the photoconductor, greatly varies depending upon the contact pressure and the setting of the nip explained above.

The value of the coefficient of friction to be maintained for obtaining the desired object for use in practice is preferably in the range of 0.4 or less, more preferably in the range of 0.1 to 0.3, furthermore preferably in the range of 0.2 to 0.3.

In other words, when the coefficient of friction is maintained in the range of about 0.2 to 0.3, the polishing effect attained by the cleaning blade and the developer can be effectively used, so that high image quality can be most effectively maintained, while controlling the abrasion of the photoconductor.

The coefficient of friction can be calculated by the following measurement method, using an Euler-belt system. The Euler-belt system is described in Japanese Laid-Open Patent Application 9-166919.

A photoconductor used as a test sample is fixed. A high quality paper belt with a width of 30 mm and a length of 290 mm, cut from the above-mentioned high quality paper, is placed on the photoconductor. A balance weight of 100 gr is attached to one end of the high quality paper belt, and a digital force gauge for measurement of weight is attached to the other end of the high quality paper belt, and the digital force gauge is slowly pulled, and the moment the belt begins to move, the weight indicated by the digital force gauge is read, and the coefficient of (static) friction is calculated from the following formula:

$$\mu s = 2/\pi \times ln(F/W)$$

wherein $\mu$s is the coefficient of static friction, F is the weight read, W is the weight of the balance weight, and $\pi$ is circular ratio.

In order to achieve the desired object by bringing the flexible lubricating material of the lubricity-imparting unit into contact with the surface of the photoconductor with the above-mentioned nip, some device is required to bring the flexible lubricating material into uniform and soft contact with the surface of the photoconductor to prevent the photoconductor from being mechanically damaged as mentioned above.

For example, when the flexible lubricating material A is used, if the flexible lubricating material A is molded in such a shape that fits the curvature of the photoconductor to obtain an appropriate nip, the desired coefficient of friction can be obtained when the flexible lubricating material A is brought into contact with the surface of the photoconductor. When high image quality is required even in making a large number of copies, the method of building the elastic member in the flexible lubricating material A is effective since this method is capable of securing stable contact of the flexible lubricating material A with the surface of the photoconductor as mentioned above.

As explained above, usually, most of unused photoconductors have originally high coefficient of friction, so that if an image formation apparatus with such a photoconductor being incorporated therein is operated without taking any step for decreasing the coefficient of friction of the photoconductor, it may occur that initial driving of the photoconductor in rotation cannot be smoothly carried out due to the locking of the photoconductor since as the material for the cleaning blade, a material like rubber is often used, so that it may occur that the desired objects of the present invention cannot be achieved.

In order to prevent such a problem from occurring and to start to drive the photoconductor in rotation without scratching the surface of the photoconductor, it is effective to apply a lubricant to a top end portion or the periphery of the cleaning blade, or to a portion of the surface of the photoconductor near the cleaning blade before initiating the operation of the image formation apparatus. It is preferable to use such a lubricant and the lubricity-imparting unit of the present invention in combination.

As such a lubricant, conventionally employed lubricants can be employed, and there is no particular restriction on the use of lubricants.

Examples of lubricants that can be employed for the above-mentioned purpose are metal fatty acid salts, such as lead oleate, zinc oleate, copper oleate, cobalt stearate, iron stearate, copper stearate, zinc palmitate, copper palmitate, and zinc linoleate; zinc fluoride; talc; and the above-mentioned fluoroplastics which can be used as the flexible lubricating materials in the present invention. Of these lubricants, powder-like fluoro-plastics such as polyvinylidene fluoride (PVDF) and polytetrafluoroethylene (PTFE) exhibit excellent effects and are suitable in view of the chemical stability thereof.

When a liquid lubricant is employed, its effect can be sufficiently obtained by applying the top end portion or the periphery of the cleaning blade. Examples of such liquid lubricants are animal oils such as whale oil and squalane oil; vegetable oils such as colza oil, safflower oil, sesame oil, camellia oil, and rice-bran oil; paraffinic and naphthenic mineral oils and petroleum oils; and synthetic oils such as ester oils, polyether oil, hydrocarbon oil, silicone oils, and fluorine-containing oils.

Examples of silicone oils are methyl phenyl silicone oil, dimethyl silicone oil, silicone polyether copolymer, modified silicone oils such as fluorine-modified silicone oil, epoxy-modified silicone oil, alcohol-modified silicone oil, alkyl-modified silicone oil, and amino-modified silicone oil. These silicone oils exhibit excellent lubricating effects, but differ in the effects differ more or less.

Examples of fluorine-containing oils are fluoro-carbon oil and perfluoroether oil.

Of the above-mentioned liquid lubricants, the silicone oils and the fluorine-containing oils are suitable for use in the present invention since they are chemically stable and non-volatile.

Lubricating greases can also be employed, It is considered that in lubricating greases, a thickener is dispersed in the form of micelles which are joined at a number of points to form a three-dimensional network structure, within which a lubricating oil is held. Examples of the thickeners for use in the lubricating greases are soap greases such as calcium soap grease, sodium soap grease, lithium soap grease, calcium complex grease and barium complex grease, and non-soap greases such as Penton, fine silica, and copper phthalocyanine allylurea, and examples of base oils for these thickeners are diethyl ester oil, silicone oil, and fluorocarbon oil.

In such greases, synthetic greases such as fluorine-based grease, silicone-based grease, and silicone-fluorine-based grease are excellent as lubricants and are suitable for use in the present invention.

By applying such a grease in the form of a thin layer to a top end portion of the cleaning blade and also to a portion therearound, and by removing excess grease therefrom, the photoconductor can be smoothly driven in rotation without causing the image quality to deteriorate.

For cleaning the surface of the photoconductor more completely, it is preferable to provide an auxiliary cleaning unit in addition to the conventionally used cleaning unit, whereby it is possible to have the lubricity-imparting unit of the present invention fulfill its function more effectively.

Figure 21:
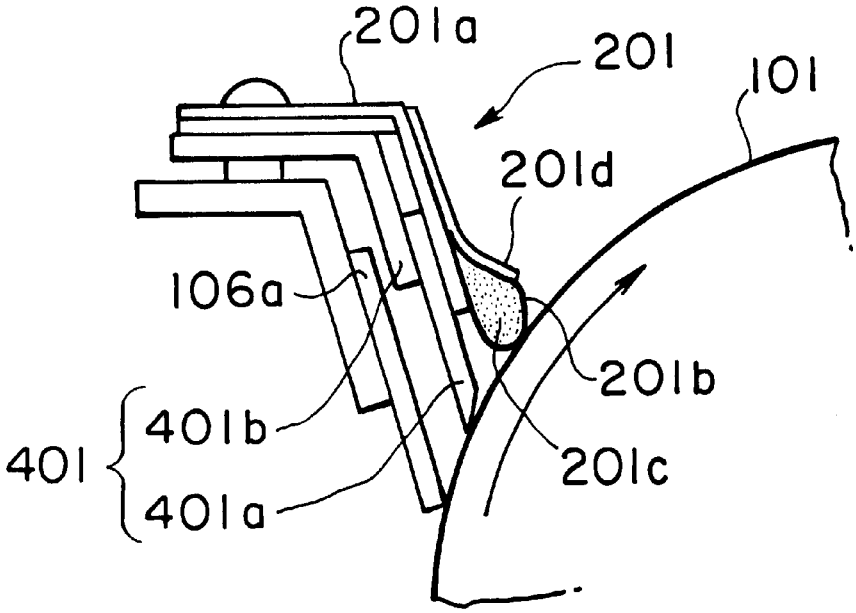
FIG. 21 is a schematic cross-sectional view of an example of a combined use of a lubricity-imparting unit of the present invention and an auxiliary cleaning unit.
Figure 22:
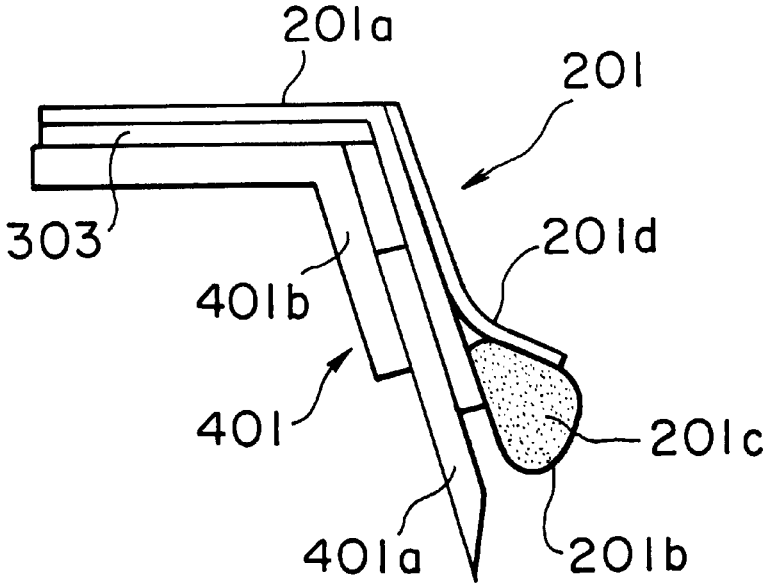
FIG. 22 is a schematic cross-sectional view of another example of a combined use of a lubricity-imparting unit of the present invention and an auxiliary cleaning unit.
Figure 23:
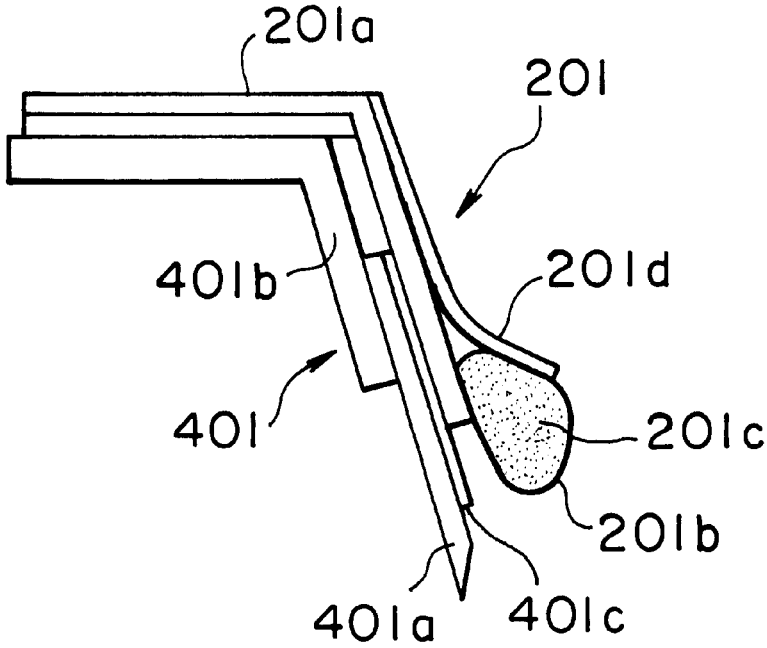
FIG. 23 is a schematic cross-sectional view of a further example of a combined use of a lubricity-imparting unit of the present invention and an auxiliary cleaning unit.

With reference to FIGS. 21 to 23, an auxiliary cleaning unit 401 will now be explained.

In FIGS. 21 to 23, reference numeral 101 indicates a photoconductor; reference numeral 106*a*, a cleaning blade; reference numeral 201, a lubricity-imparting unit of the present invention; reference numeral 201*a*, a support base, reference numeral 201*b*, a flexible lubricating material; reference numeral 201*c*, an elastic member; reference numeral 201*d*, a holding member; reference numeral 303, an L angle; reference numeral 401, an auxiliary cleaning unit; reference numeral 401*a*, an auxiliary cleaning member; reference numeral 401*b*, a support base; and reference numeral 401*c*, a reinforcing plate.

The auxiliary cleaning unit 401 has such a structure that is composed of the auxiliary cleaning member 401*a* and a support base 401*b*for supporting the auxiliary cleaning member 401*a*. As the material for the auxiliary cleaning member 401*a*, there can be employed materials by which the surface of the photoconductor 101 is hardly scratched, for instance, polyurethane rubber, chloroprene rubber, neoprene rubber, fluororubber and silicone rubber.

It is preferable that the material for the auxiliary cleaning member 401*a* have a hardness of 50 to 85 degree in terms of Asker C hardness, and have a thickness of about 1 to 3 mm When the material has excessively high hardness, there is the risk that the photoconductor is scratched by the cleaning member 401*a*, while when the material for the cleaning member 401*a* is not hard enough, there is the risk that foreign materials freely pass through between the auxiliary cleaning member 401*a* and the surface of the photoconductor 101, so that the auxiliary cleaning member 401*a* does not fulfill its cleaning function. Therefore, it is more preferable that the material for the auxiliary cleaning member 401*a* have a hardness in the range of about 65 to 80 degree. The hardness of the material for the auxiliary cleaning member 401*a* is appropriately set with the hardness of the photoconductor, the physical properties of the surface of the photoconductor, and the contact angle of the auxiliary cleaning member 401*a* with respect to the surface of the photoconductor being taken into consideration.

As shown in FIG. 21 and FIG. 22, the auxiliary cleaning member 401*a* is attached counter to the rotating direction of the photoconductor 101. In the case where the auxiliary cleaning member 401*a* has a thickness of about 2 to 3 mm, it is preferable that a top end portion of the auxiliary cleaning member 401*a* be cut on the slant in such a shape as shown in FIGS. 21, 22 and 23, thereby securely removing foreign materials such as toner particles on an inlet side of the auxiliary cleaning unit 401. This is effective for avoiding the above-mentioned risk that foreign materials freely pass through between the auxiliary cleaning member 401*a* and the surface of the photoconductor 101. Even in the case where the auxiliary cleaning member 401*a* is as thin as about 1 mm, it is still desirable that a top end portion of the auxiliary cleaning member 401*a* be cut on the slant, but simple cutting at right angles will not cause any particular problems. There is no restriction on the cutting angle since the cutting angle varies depending upon the setting position of the auxiliary cleaning member 401*a*.

The length from the top end portion of the support base 401*b*to the top end portion of the auxiliary cleaning member 401*a* also varies depending upon, for instance, the thickness of the auxiliary cleaning member 401*a*, the space therefor, and the cleaning performance of the auxiliary cleaning member 401*a*. The length is usually set at 15 mm or less. The thinner the auxiliary cleaning member 401*a*, the shorter the length to be set.

In connection with the space for the auxiliary cleaning member 401*a*, when the auxiliary cleaning member 401*a* has a thickness of 1 mm, it is preferable that the length be 10 mm or less, more preferably, about 5 mm. In this case, it is preferable that a reinforcing plate 401*c* be used as shown in FIG. 23. As the reinforcing plate 401*c*, an aluminum plate with a thickness of about 0.1 to 0.2 mm can be used, and can be sufficiently fixed, using a double-coated adhesive tape.

It is also preferable that a space of 1 mm or more be placed between the cleaning blade 106*a* and the auxiliary cleaning member 401*a* as illustrated in FIG. 21.

Examples of the image formation apparatus in which the lubricity-imparting unit of the present invention is incorporated will now be explained with reference to FIGS. 12 to 17.

Figure 12:
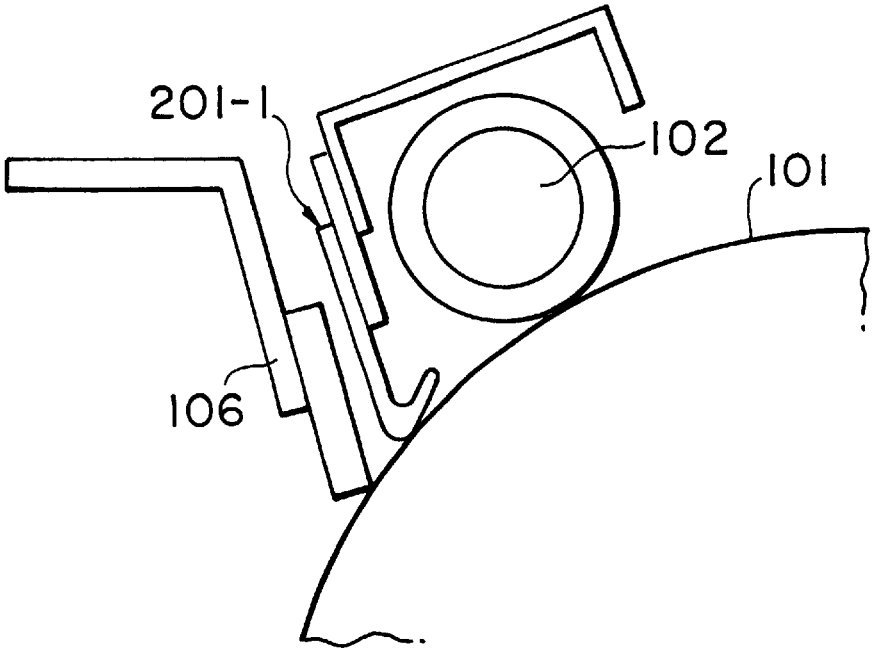
FIG. 12 is a schematic partial cross-sectional view of an example of an image formation apparatus of the present invention, in which the lubricity-imparting unit as shown in FIG. 5(*a*) is incorporated, by attaching the lubricity-imparting unit 201-1 to a cover of a charging unit of the image formation apparatus.

FIG. 12 is a schematic cross-sectional view of an example of the image formation apparatus in which the lubricity-imparting unit 202-1 as shown in FIG. 5(*a*) is incorporated, by attaching the lubricity-imparting unit 202-1 to a cover of the charging unit 102. The attachment of the lubricity-imparting unit 201-1 is not limited to this method, but the lubricity-imparting unit 201-1 can be attached to either a metal base portion of a cleaning blade of the cleaning unit 106 or a housing of the image formation apparatus (not shown). The lubricity-imparting unit 201-2 as shown in FIG. 5(*b*) can also be incorporated in the image formation apparatus in the same manner as with the above-mentioned lubricity-imparting unit 201-1 as shown in FIG. 5(*a*).

FIG. 13 is a schematic cross-sectional view of another example of the image formation apparatus in which the lubricity-imparting unit 201-3(*a*) as shown in FIG. 6(*a*) is incorporated, by attaching the lubricity-imparting unit 201-3(*a*) to the cover of the charging unit 102.

Figure 14:
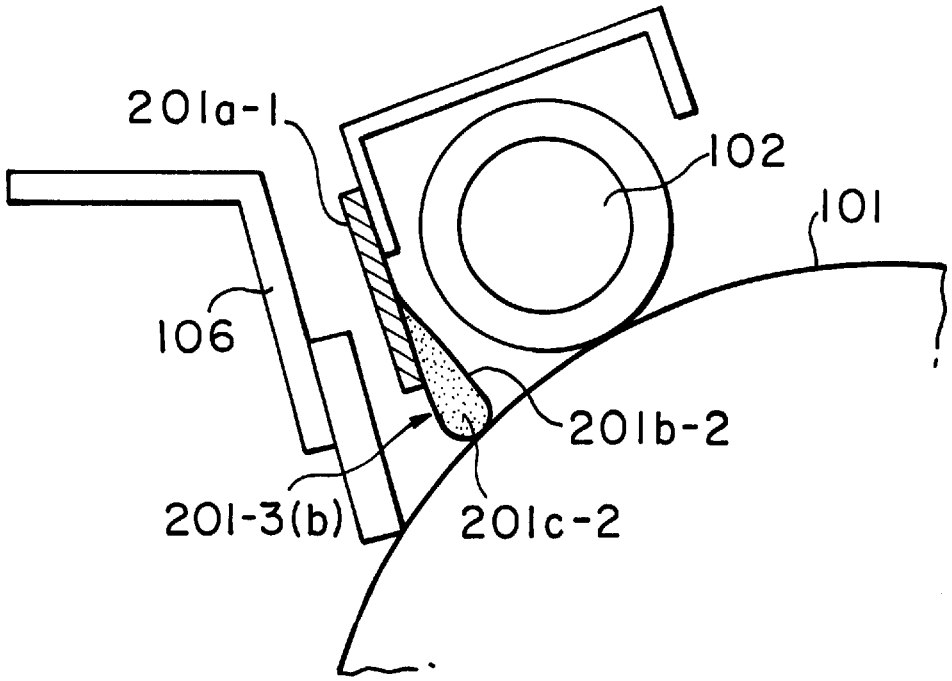
FIG. 14 is a schematic partial cross-sectional view of a further example of an image formation apparatus of the present invention, in which the lubricity-imparting unit as shown in FIG. 6(*b*) is incorporated, by attaching the lubricity-imparting unit to the cover of the charging unit.

FIG. 14 is a schematic cross-sectional view of a further example of the image formation apparatus in which the lubricity-imparting unit 201-3(*b*) as shown in FIG. 6(*b*) is incorporated, by attaching the lubricity-imparting unit 201-3(*b*) to the cover of the charging unit 102. Within the bag-like swollen portion of the lubricity-imparting unit 201-3(*b*) , the elastic member 201*c*-2 is placed. The lubricity-imparting unit 201-3(*b*) can be attached to the cover of the charging unit 102, either by using the above-mentioned strong double-coated adhesive tape, or by using a rail (not shown) for easy replacement of the lubricity-imparting unit 201-3(*b*) with a new one.

FIG. 15 is a schematic cross-sectional view of a further example of the image formation apparatus in which the lubricity-imparting unit 201-5 as shown in FIG. 8 is incorporated, by attaching the lubricity-imparting unit 201-5 to a metal base portion of the blade cleaning unit 106. In this setting method for the lubricity-imparting unit, a spring 302 is interposed between the metal base portion of the blade cleaning unit 106 and an L-shaped angle 303 with a thickness of 1 to 2 mm molded from aluminum, acrylic resin or polyvinyl chloride resin, whereby the contact pressure of the lubricity-imparting unit 201-5 to be applied to the surface of the photoconductor 101 can be adjusted.

The lubricity-imparting unit of the present invention can be detachably fixed to the metal base portion of the cleaning unit or to the cover of the charging unit through a rail provided thereon or to the housing of the image formation apparatus, whereby the detachment of the lubricity-imparting unit for replacement thereof can be facilitated.

For instance, in a commercially available electrophotographic copying machine ("MF 200" (Trademark) made by Ricoh Co., Ltd.), the photoconductor, the cleaning unit and the development unit are integrated into one unit, so that the lubricity-imparting unit of the present invention can be set in the electrophoto-graphic copying machine by utilizing an attachment portion of the cleaning unit.

Figure 16:
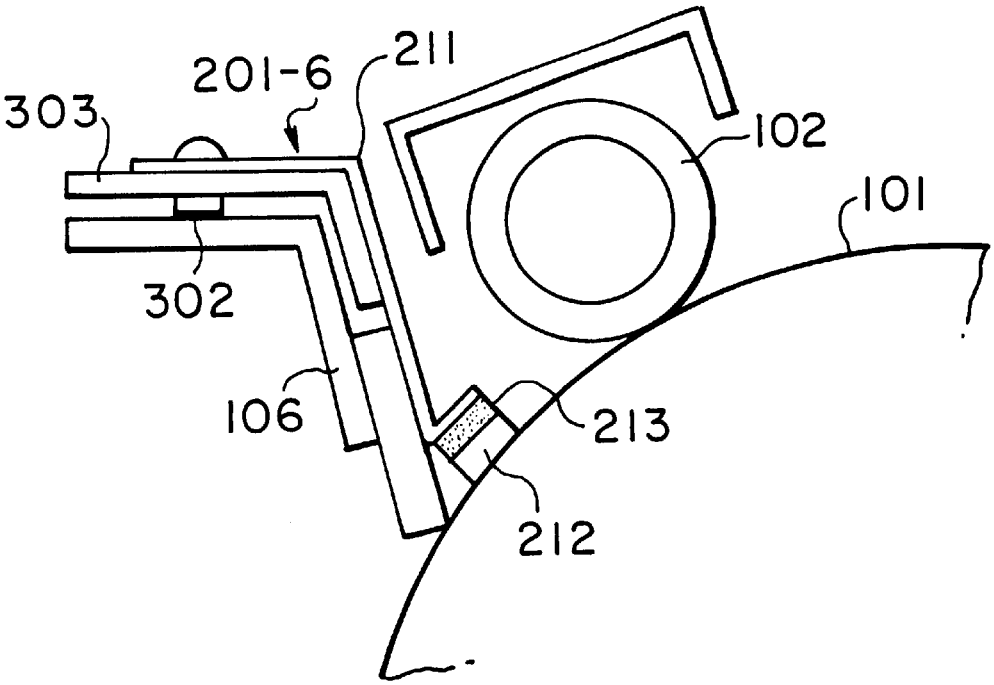
FIG. 16 is a schematic partial cross-sectional view of a further example of an image formation apparatus of the present invention, in which the lubricity-imparting unit as shown in FIG. 10 is incorporated, by attaching the lubricity-imparting unit to the metal base portion of the blade cleaning unit.

FIG. 16 is a schematic cross-sectional view of a further example of the image formation apparatus in which the lubricity-imparting unit 201-6 as shown in FIG. 10 is incorporated, by attaching the lubricity-imparting unit 201-6 to the metal base portion of the blade cleaning unit 106. As shown in FIG. 10, the lubricity-imparting unit 201-6 is composed of the elastic structure 212 which is attached to the support base 211 through the elastic member 213, for instance, using an ultra strong double-coated adhesive tape.

Figure 17:
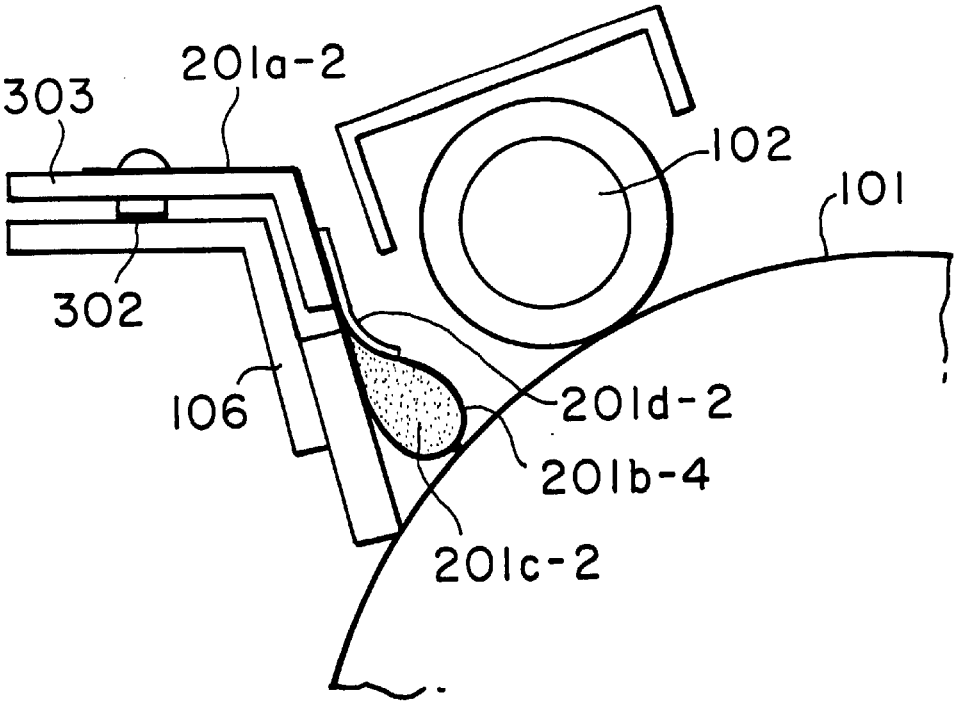
FIG. 17 is a schematic partial cross-sectional view of a further example of an image formation apparatus of the present invention, in which the lubricity-imparting unit as shown in FIG. 11 is incorporated, by attaching the lubricity-imparting unit to the metal base portion of the blade cleaning unit.

FIG. 17 is a schematic cross-sectional view of a further example of the image formation apparatus in which the lubricity-imparting unit 201-7 as shown in FIG. 11 is incorporated, by attaching the lubricity-imparting unit 201-7 to the metal base portion of the blade cleaning unit 106. The lubricity-imparting unit 201-7 is stable in operation and is suitable for use in making 100,000 to 200,000 copies.

For instance, in the lubricity-imparting unit 201-7 as shown in FIG. 11, if a red or blue mark is formed by printing or manually drawing, using an oil ink such as a paint or a line marker, on a back side of the flexible lubricating material 201*b*-4 opposite to the side thereof which comes into contact with the surface of the photoconductor 101 over an entire contacting range with a width more than that of the contacting range of the flexible lubricating material 201*b*-4 with the photoconductor 101 (normally with a width of about 5 mm), the marker becomes gradually visible as the abrasion of the flexible lubricating material 201*b*-4 advances, so that this mark makes it possible to assess the degree of the abrasion of the flexible lubricating material 201*b*-4 and to determine the timing for replacement of the flexible lubricating material 201*b*-4.

Other features of this invention will become apparent in the course of the following description of exemplary embodiments, which are given for illustration of the invention and are not intended to be limiting thereof.

[Preparation of Electrophotographic Photoconductor]

On an external surface of an aluminum drum with a diameter of 30 mm and a length of 340 mm, a coating liquid for forming an undercoat layer, a coating liquid for forming a charge generation layer, and a coating liquid for forming a charge transport layer, with the following respective formulations, were successively coated in a superimposing manner, and dried, whereby there was fabricated an electrophotographic photo-conductor which was composed of an overcoat layer with a thickness of 3.5 μm, a charge generation layer with a thickness of 0.2 μm, and a charge transport layer with a thickness of 25 μm which were overlaid on the external surface of the aluminum drum.

[Formulation of Coating Liquid for Formation of Undercoat Layer]

| | Parts by Weight |
|---|---|
| Alkyd resin ("Beckosol 1307-60-EL" (Trademark), made by Dainippon Ink & Chemicals, Incorporated) | 6 |
| Melamine resin ("Super Beckamine G-821-60" (Trademark), made by Dainippon Ink & Chemicals, Incorporated) | 4 |
| Titanium oxide | 40 |
| Methyl ethyl ketone | 200 |

[Formulation of Coating Liquid for Formation of Charge Generation Layer]

| | Parts by Weight |
|---|---|
| Trisazo pigment of the following formula: | 2.5 |

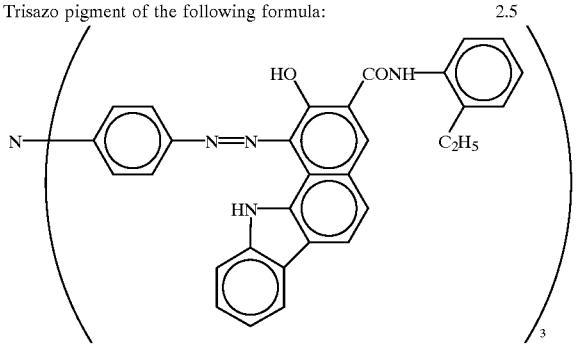

| | |
|---|---|
| Polyvinyl butyral ("XYHL" (Trademark), made by Union Carbide Japan K.K.) | 0.5 |
| Cyclohexanone | 200 |
| Methyl ethyl ketone | 80 |

[Formulation of Coating Liquid for Formation of Charge Transport Layer]

| | Parts by Weight |
|---|---|
| Bisphenol A-type Polycarbonate ("Panlite K-1300" (Trademark), made by Teijin Chemicals Ltd.) | 10 |

-continued

| | Parts by Weight |
|---|---|
| Low-molecular weight charge transport material of the following formula: | 10 |

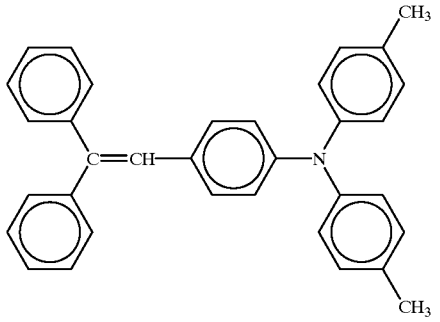

| | |
|---|---|
| Methylene chloride | 100 |
| Methylphenyl silicone oil (50 cs) | several drops |

EXAMPLE 1

A lubricity-imparting unit 201-2 with the structure as shown in FIG. 5(*b*) was fabricated by using a fluoroplastic film (polytetraluoroethylene resin (PTFE), "NAFLON PTFE TAPE (TOMBO9001)(Trademark), made by Nichias Corporation) with a thickness of 200 μm as the flexible lubricating material 201*b*-1, and a polycarbonate sheet with a thickness of 300 μm as the support base 201*a*-1.

For evaluating the lubricity-imparting effect of the thus fabricated lubricity-imparting unit 201-2, the lubricity-imparting unit 201-2 was installed in a commercially available electrophotographic copying machine ("IMAGIO MF200" (Trademark) made by Ricoh Company, Ltd.) with the above prepared photoconductor incorporated therein.

More specifically, the lubricity-imparting unit 201-2 was set between a toner cleaning unit and a charging unit by attaching the same to a cover portion of the charging unit in a photoconductor unit of the electro-photographic copying machine, using a double-coated adhesive tape, in such a posture so as to apply a contact pressure of 45 to 55 gr to the surface of the photoconductor.

[Evaluation of the Effects of Lubricity-imparting Unit 201-2]

Using a predetermined A3 size original and A4 size copy sheets, 10,000 copies were made per day at 22 to 24° C./66 to 70%RH, and the changes in the coefficient of friction of the surface of the photoconductor were measured by the above-mentioned method, and the changes in the thickness of the flexible lubricating material 201*b*-1 and the abrasion of the photoconductive layer of the photoconductor by abrasion were measured, using an eddy current type coating thickness meter made by Fischer Instruments K.K. Furthermore, image quality obtained was also evaluated. The evaluation of the image quality was also conducted at 30°C./90%RH. For these evaluations, the total number of copies made was 50,000 to 100,000.

In the course of these evaluations, when necessary, the used lubricity-imparting unit 201-2 was replaced with a new one.

[Results]

The results are shown in TABLE 1. The changes in the coefficient of friction of the surface of the photo-conductor with the increase in the number of copies made are shown in the graph in FIG. 18.

Figure 18:
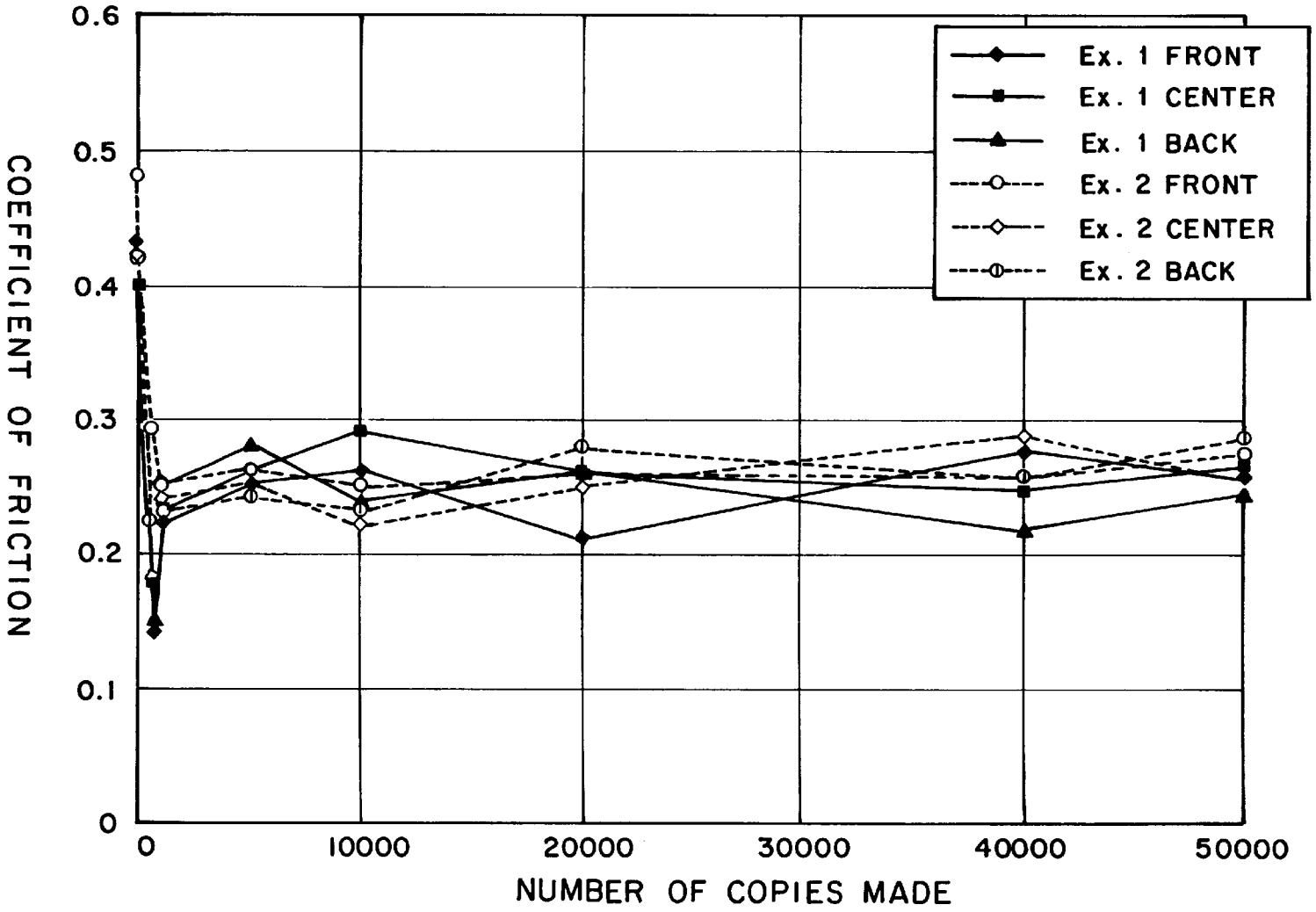
FIG. 18 is a graph showing the changes in the coefficient of friction of the surface of a photoconductor with the increase in the number of copies made in Example 1 and Example 2.

The results shown in FIG. 18 indicate that the coefficient of friction of the surface of the photo-conductor sharply decreased until the number of copies made reached about 100, and thereafter the coefficient of friction made almost no changes until 50,000 copies were made.

In the graph shown in FIG. 18, the term "front" denotes a measured position on the surface of the photoconductor, which was 70 mm away from one end of the photoconductor, the term "center" denotes a measured position on the surface of the photoconductor, which was 170 mm away from the above-mentioned one end of the photoconductor, and the term "back" denotes a measured position on the surface of the photoconductor, which was 270 mm away from the above-mentioned one end of the photoconductor.

The results indicate that the lubricity-imparting unit 201-2 fabricated in Example 1 obviously exhibited the desired lubricity-imparting effect.

EXAMPLE 2

A lubricity-imparting unit 201-2 with the same structure as that of the lubricity-imparting unit 201-2 in Example 1 was fabricated in the same manner as in Example 1 except that the 200 μm thick fluoroplastic film employed in Example 1 was replaced by a 500 μm thick fluoroplastic film made of the same material as that employed in Example 1, and was then evaluated with respect to the same evaluation items in the same manner as in Example 1.

The results are shown in TABLE 1 and FIG. 18. The results indicate that the lubricity-imparting unit 201-2 fabricated in this Example obviously exhibited the desired lubricity-imparting effect. When this lubricity-imparting unit 201-2 was used, slight streaks were observed on the surface of the photoconductor after 50,000 copies were copied. However, the appearance of such streaks did not cause any problem in image quality for use in practice.

EXAMPLE 3

A lubricity-imparting unit 201-3(*a*) with the structure as shown in FIG. 6(*a*) was fabricated by using a fluoroplastic film (polytetraluoroethylene resin (FTFE), "NAFLON PTFE TAPE (TOMBO9001)(Trademark), made by Nichias Corporation) with a thickness of 50 μm as the flexible lubricating material 201*b*-2, and a polycarbonate sheet with a thickness of 300 μm as the support base 201*a*-1.

For evaluating the lubricity-imparting effect of the thus fabricated lubricity-imparting unit 201-3(*a*) , the lubricity-imparting unit 201-3(*a*) was installed in the same commercially available electrophotographic copying machine ("IMAGIO MF200" (Trademark) made by Ricoh Company, Ltd.) as used in Example 1, with the above prepared photoconductor being incorporated therein, and the lubricity-imparting unit 201-3(*a*) being set between the toner cleaning unit and the charging unit by attaching the same to the cover portion of the charging unit in the photoconductor unit of the electrophotographic copying machine, using a double-coated adhesive tape, in such a posture so as to apply a contact pressure of 40 gr to the surface of the photoconductor.

Thus, the lubricity-imparting unit 201-3(*a*) was then evaluated with respect to the same evaluation items in the same manner as in Example 1.

The results are shown in TABEL 1. The results indicate that the lubricity-imparting unit 201-3(*a*) fabricated in this Example exhibited the desired lubricity-imparting effect and had no problems with respect to the changes in the coefficient of friction of the photoconductor and the abrasion of the photo-conductive layer of the photoconductor.

EXAMPLE 4

A lubricity-imparting unit 201-3(*a*) with the same structure as that of the lubricity-imparting unit 201-3(*a*) fabricated in Example 3 was fabricated in the same manner as in Example 3 except that the 50 μm thick fluoroplastic film employed in Example 3 was replaced by a 100 μm thick fluoroplastic film made of the same material as that employed in Example 3, and was then evaluated with respect to the same evaluation items in the same manner as in Example 3.

The results are shown in TABEL 1. The results indicate that the lubricity-imparting unit 201-3(*a*) fabricated in this Example also exhibited the desired lubricity-imparting effect and had no problems with respect to the changes in the coefficient of friction of the photoconductor and the abrasion of the photoconductive layer of the photoconductor.

EXAMPLE 5

A lubricity-imparting unit 201-3(*a*) with the same structure as that of the lubricity-imparting unit 201-3(*a*) fabricated in Example 3 was fabricated in the same manner as in Example 3 except that the 50 μm thick fluoroplastic film employed in Example 3 was replaced by a 200 μm thick fluoroplastic film made of the same material as that employed in Example 3, and was then evaluated with respect to the same evaluation items in the same manner as in Example 3. The results are shown in TABEL 1.

The results indicate that the lubricity-imparting unit 201-3(*a*) fabricated in this Example also exhibited the desired lubricity-imparting effect and had no problems with respect to the changes in the coefficient of friction of the photoconductor and the abrasion of the photo-conductive layer of the photoconductor.

EXAMPLE 6

A lubricity-imparting unit 201-4 with the structure as shown in FIG. 7 was fabricated by using a fluoroplastic film (polytetraluoroethylene resin (PTFE), "NAFLON PTFE TAPE (TOMBO9001) (Trademark), made by Nichias Corporation) with a thickness of 50 μm as the flexible lubricating material 201*b*-3, a polycarbonate sheet with a thickness of 300 μm as the support base 201*a*-1, and an artificial leather ("Ecsaine" (Trademark) made by Toray Industries) as the elastic member 201*c*-1.

For evaluating the lubricity-imparting effect of the thus fabricated lubricity-imparting unit 201-4, the lubricity-imparting unit 201-4 was installed in the same commercially available electrophotographic copying machine ("IMAGIO MF200" (Trademark) made by Ricoh Company, Ltd.) as employed in Example with the above prepared photoconductor being incorporated therein, and with the lubricity-imparting unit 201-4 being set between the toner cleaning unit and the charging unit by attaching the same to the blade attachment support of the toner cleaning unit in the photoconductor unit of the electrophotographic copying machine, using an L-shaped angle 303 as shown in FIG. 15, and also using a double-coated adhesive tape ("#442J" made by Sumitomo 3M Limited) in such a posture so as to apply a contact pressure of 40 to 60 gr to the surface of the photoconductor.

Thus, the lubricity-imparting unit 201-4 was then evaluated with respect to the same evaluation items in the same manner as in Example 1.

The results are shown in TABEL 1. The results indicate that the lubricity-imparting unit 201-4 fabricated in this Example exhibited the desired lubricity-imparting effect sufficiently although slight streaks were observed not only in the images, but also on the surface of the photoconductor.

EXAMPLE 7

A lubricity-imparting unit 201-4 with the same structure as that of the lubricity-imparting unit 201-4 fabricated in Example 6 was fabricated in the same manner as in Example 6 except that the 50 μm thick fluoroplastic film employed in Example 6 was replaced by a 100 μm thick fluoroplastic film made of the same material as that employed in Example 6, and was then evaluated with respect to the same evaluation items in the same manner as in Example 6.

The results are shown in TABEL 1. The results indicate that the lubricity-imparting unit 201-4 fabricated in this Example exhibited the desired lubricity-imparting effect sufficiently.

EXAMPLE 8

A lubricity-imparting unit 201-4 with the same structure as that of the lubricity-imparting unit 201-4 in Example 6 was fabricated in the same manner as in Example 6 except that the artificial leather employed as the elastic material 201*c*-1 in Example 6 was replaced by a urethane foam ("PORON LE-20" (Trademark), made by INOAC CORPORATION) with the characteristics (density: 0.2 g/cm$^2$, tensile strength: 3.1 kg/ cm$^2$, elongation: 150%, compressive residual strain: 5.9%), and was then evaluated with respect to the same evaluation items in the same manner as in Example 6.

The results are shown in TABEL 1. The results indicate that the lubricity-imparting unit 201-4 fabricated in this Example exhibited the desired lubricity-imparting effect sufficiently.

EXAMPLE 9

A lubricity-imparting unit 201-4 with the same structure as that of the lubricity-imparting unit 201-4 in Example 7 was fabricated in the same manner as in Example 6 except that the artificial leather employed as the elastic material 201*c*-1 in Example 7 was replaced by a urethane foam "PORON LE-20" (Trademark), made by INOAC CORPORATION, with the characteristics (density: 0.2 g/cm$^2$, tensile strength: 3.1 kg/ cm$^2$, elongation: 150%, compressive residual strain: 5.9%), and was then evaluated with respect to the same evaluation items in the same manner as in Example 6.

The results are shown in TABEL 1. The results indicate that the lubricity-imparting unit 201-4 fabricated in this Example exhibited the desired lubricity-imparting effect sufficiently.

EXAMPLE 10

A lubricity-imparting unit 201-5 with the structure as shown in FIG. 8 was fabricated by using a fluoro-plastic film (polytetraluoroethylene resin (PTFE), "NAFLON PTFE TAPE (TOMBO9001)(Trademark), made by Nichias Corporation) with a thickness of 50 μm as the flexible lubricating material 201*b*-3, a polycarbonate sheet with a thickness of 300 μm as the support base 201*a*-1, a polyethylene terephthalate resin film with a thickness of 250 μm as a holding plate 201*d*-1, and 2 mm thick and 3 mm thick urethane foams ("PORON LE-20" (Trademark), made by INOAC CORPORATION, with the characteristics (density: 0.2 g/cm$^2$, tensile strength: 3.1 kg/ cm$^2$, elongation: 150%, compressive residual strain: 5.9%) as the elastic material 201*c*-1.

In the above, the flexible lubricating material 201*b*-3 was fabricated by superimposing and bonding two of the 50 μm thick fluoroplastic films in such a posture that was free of any shift therebetween, using a double-coated adhesive tape, at a bonding portion which is away from its contacting portion with the surface of the photoconductor.

For evaluating the lubricity-imparting effect of the thus fabricated lubricity-imparting unit 201-5, the lubricity-imparting unit 201-5 was installed in the same commercially available electrophotographic copying machine ("IMAGIO MF200" (Trademark) made by Ricoh Company, Ltd.) as used in Example 1, with the above prepared photoconductor being incorporated therein, and with the lubricity-imparting unit 201-5 being set between the toner cleaning unit and the charging unit by attaching the same to the blade attachment support of the toner cleaning unit in the photoconductor unit of the electrophotographic copying machine, using an L-shaped angle 303 as shown in FIG. 15, and also using a double-coated adhesive tape ("#442J" made by Sumitomo 3M Limited) in such a posture so as to apply a contact pressure of 40 to 60 gr to the surface of the photoconductor.

Thus, the lubricity-imparting unit 201-5 was then evaluated with respect to the same evaluation items in the same manner as in Example 1.

The results are shown in TABEL 1. The results indicate that the lubricity-imparting unit 201-5 fabricated in this Example exhibited the desired lubricity-imparting effect sufficiently although the flexible lubricating material 201*b*-3 made of the 50 μm thick fluoroplastic film had a slight problem with respect to its durability due to the abrasion thereof, and black streaks were formed in the images.

EXAMPLE 11

A lubricity-imparting unit 201-5 with the same structure as that of the lubricity-imparting unit 201-5 in Example 10 was fabricated in the same manner as in Example 10 except that the 50 μm thick fluoroplastic film employed as the flexible lubricating material 201*b*-3 in Example 10 was replaced by a 100 μm thick fluoroplastic film made of the same material as that employed in Example 10, and was then evaluated with respect to the same evaluation items in the same manner as in Example 1.

Figure 19:
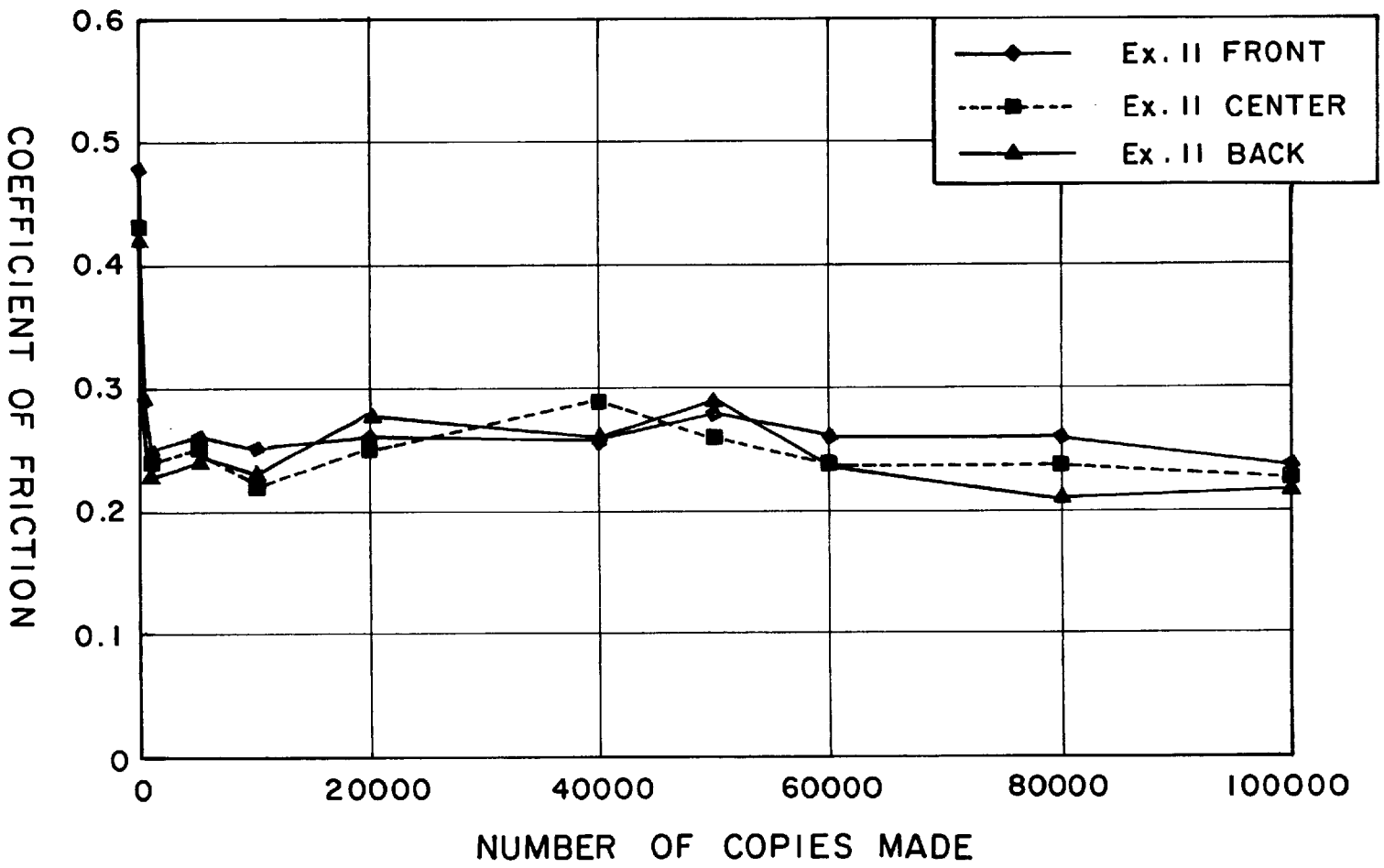
FIG. 19 is a graph showing the changes in the coefficient of friction of the surface of the photoconductor with the increase in the number of copies made in Example 11.

The results are shown in TABEL 1 and in the graph in FIG. 19.

The changes in the coefficient of friction of the surface of the photoconductor with the increase in the number of copies made are shown in the graph in FIG. 19.

The results shown in FIG. 19 indicate that the coefficient of friction of the surface of the photo-conductor decreased until the number of copies made reached about 100, and thereafter the coefficient of friction made almost no changes until 50,000 copies were made. In the graph shown in FIG. 19, the terms "front", "center" and "back" respectively denote the same meaning as in FIG. 18.

The results indicate that the lubricity-imparting unit 201-5 fabricated in this Example exhibited the desired lubricity-imparting effect and had no problems with respect to the image quality obtained and also with respect to the abrasion of the flexible lubricating material 201*b*-3 with a sufficient allowance therein.

EXAMPLE 12

A lubricity-imparting unit 201-5 with the structure as shown in FIG. 8 was fabricated by using a fluoroplastic film (polytetraluoroethylene resin (PTFE), "NAFLON PTFE TAPE (TOMBO9001) (Trademark), made by Nichias Corporation) with a thickness of 50 μm as the flexible lubricating material 201*b*-3, which was lined with a 25 μm thick polyethylene terephthalate film ("Lumirror" (Trademark) made by Toray Industries, Inc.), provided with a double-coated adhesive tape, a polycarbonate sheet with a thickness of 300 μm as the support base 201*a*-1, a polyethylene terephthalate resin film with a thickness of 250 μm as a holding plate 201*d*-1, and a 2 mm thick urethane foam ("PORON LE-20" (Trademark), made by INOAC CORPORATION, with the characteristics (density: 0.29 g/cm$^2$, tensile strength: 3.1 kg/ cm$^2$, elongation: 150%, compressive residual strain: 5.9%) as the elastic material 201*c*-1.

For evaluating the lubricity-imparting effect of the thus fabricated lubricity-imparting unit 201-5, the lubricity-imparting unit 201-5 was installed in the same commercially available electrophotographic copying machine ("IMAGIO MF200" (Trademark) made by Ricoh Company, Ltd.) as employed in Example 1, with the above prepared photoconductor being incorporated therein, and with the lubricity-imparting unit 201-5 being set between the toner cleaning unit and the charging unit by attaching the same to the blade attachment support of the toner cleaning unit in the photoconductor unit of the electrophotographic copying machine, using an L-shaped angle 303 as shown in FIG. 15, and also using a double-coated adhesive tape ("#442J" made by Sumitomo 3M Limited) in such a posture so as to apply a contact pressure of 40 to 60 gr to the surface of the photoconductor.

Thus, the lubricity-imparting unit 201-5 was then evaluated with respect to the same evaluation items in the same manner as in Example 1.

The results are shown in TABEL 1. The results indicate that the lubricity-imparting unit 201-5 fabricated in this Example exhibited the desired lubricity-imparting effect sufficiently, and the fluoroplastic film used as the flexible lubricating material 201*b*-3 became significantly difficult to break and distort due to the reinforcement thereof using the 25 μm thick polyethylene terephthalate film as the liner therefor, so that the handling of the flexible lubricating material 201*b*-3 became advantageously easier in comparison with that of the flexible lubricating material 201*b*-3 without such a liner.

EXAMPLE 13

A lubricity-imparting unit 201-5 with the same structure as that of the.lubricity-imparting unit 201-5 in Example 12 was fabricated in the same manner as in Example 12 except that the 50 μm thick fluoroplastic film employed in Example 12 was replaced by a 100 μm thick fluoroplastic film made of the same material as that of the 50 μm thick fluoroplastic film employed in Example 12, and that the 25 μm thick polyethylene terephthalate film ("Lumirror" (Trademark) made by Toray Industries, Inc.) used as the liner for the 50 μm thick fluoroplastic film employed in Example 12 was replaced by a 50 μm thick polyethylene terephthalate film ("Lumirror" (Trademark) made by Toray Industries, Inc.).

The thus fabricated lubricity-imparting unit 201-5 was then evaluated with respect to the same evaluation items in the same manner as in Example 1.

The results are shown in TABEL 1. The results indicate that the lubricity-imparting unit 201-5 fabricated in this Example exhibited the desired lubricity-imparting effect sufficiently, and the fluoroplastic film used as the flexible lubricating material 201*b*-3 became significantly difficult to break and distort due to the reinforcement thereof using the 50 μthick polyethylene terephthalate film as the liner therefor, so that the handling of the flexible lubricating material 201*b*-3 became advantageously easier in comparison with that of the flexible lubricating material 201*b*-3 without such a liner.

EXAMPLE 14

A lubricity-imparting unit 201-5 with the same structure as that of the lubricity-imparting unit 201-5 in Example 12 was fabricated in the same manner as in Example 12 except that the 25 μm thick polyethylene terephthalate film ("Lumirror" (Trademark) made by Toray Industries, Inc.) used as the liner for the 50 μm thick fluoroplastic film employed in Example 12 was replaced by an adhesive-applied acetate film (Mending Tape made by Sumitomo 3M Limited).

The thus fabricated lubricity-imparting unit 201-5 was then evaluated with respect to the same evaluation items in the same manner as in Example 1.

The results are shown in TABEL 1. The results indicate that the lubricity-imparting unit 201-5 fabricated in this Example exhibited the desired lubricity-imparting effect sufficiently, and the fluoroplastic film used as the flexible lubricating material 201*b*-3 became significantly difficult to break and distort due to the reinforcement thereof using the above-mentioned adhesive-applied acetate film as the liner therefor, so that the handling of the flexible lubricating material 201*b*-3 became advantageously easier in comparison with that of the flexible lubricating material 201*b*-3 without such a liner.

EXAMPLE 15

A lubricity-imparting unit 201-5 with the structure as shown in FIG. 8 was fabricated by using a fluoroplastic film (polytetraluoroethylene resin (PTFE), "NAFLON PTFE TAPE (TOMBO9001) (Trademark), made by Nichias Corporation) with a thickness of 50 μm as the flexible lubricating material 201*b*-3, on the inside of which was marked, using an oil pen, with a band-shaped mark with a width of 20 mm extending over an entire image formation region of the photoconductor in a lengthwise direction thereof, at a position corresponding to its outside contacting position with the photoconductor, lined with an adhesive-applied acetate film (Mending Tape made by Sumitomo 3M Limited) with a width of ¼ inch, a polycarbonate sheet with a thickness of 300 μm as the support base 201*a*-1, a polyethylene terephthalate resin film with a thickness of 250 μm as a holding plate 201*d*-1, and a 2 mm thick urethane foam ("PORON LE-20" (Trademark), made by INOAC CORPORATION, with the characteristics (density: 0.2 g/cm$^2$, tensile strength: 3.1 kg/cm$^2$, elongation: 150%, compressive residual strain: 5.9%) as the elastic material 201*c*-1.

For evaluating the lubricity-imparting effect of the thus fabricated lubricity-imparting unit 201-5, the lubricity-imparting unit 201-5 was installed in the same commercially available electrophotographic copying machine ("IMAGIO MF200" (Trademark) made by Ricoh Company, Ltd.) as used in Example 1, with the above prepared photoconductor being incorporated therein, and with the lubricity-imparting unit 201-5 being set between the toner cleaning unit and the charging unit by attaching the same to the blade attachment support of the toner cleaning unit in the photoconductor unit of the electrophotographic copying machine, using an L-shaped angle 303 as shown in FIG. 15, and also using a double-coated adhesive tape ("#442J" made by Sumitomo 3M Limited) in such a posture so as to apply a contact pressure of 40 to 60 gr to the surface of the photoconductor.

Thus, the lubricity-imparting unit 201-5 was then evaluated with respect to the same evaluation items in the same manner as in Example 1.

The results are shown in TABEL 1. The results indicate that the lubricity-imparting unit 201-5 fabricated in this Example exhibited the desired lubricity-imparting effect sufficiently.

Furthermore, in the course of the making of copies, the 50 μm thick fluoroplastic film was conspicuously abraded and the mark on the inside thereof was made visible.

EXAMPLE 16

A lubricity-imparting unit 201-5 with the same structure as that of the lubricity-imparting unit 201-5 in Example 15 was fabricated in the same manner as in Example 15 except that the 50 μm thick fluoroplastic film used as the flexible lubricating material 201*b*-3 was replaced by a 100 μm thick fluoroplastic film of the same material as that of the 50 μm thick fluoroplastic film employed in Example 15, and that the adhesive-applied acetate film (Mending Tape made by Sumitomo 3M Limited) employed in Example 15 was not applied to the inner side thereof, provided that the same mark as in Example 15 was formed on the inside of the 100 μm thick fluoroplastic film.

The thus fabricated lubricity-imparting unit 201-5 was then evaluated with respect to the same evaluation items in the same manner as in Example 1.

The results are shown in TABEL 1. The results indicate that the lubricity-imparting unit 201-5 fabricated in this Example exhibited the desired lubricity-imparting effect sufficiently.

Furthermore, in the course of the making of copies, the 100 μm thick fluoroplastic film was abraded and the mark on the inside thereof was made visible for indicating an appropriate timing for replacement of the flexible lubricating material 201*b*-3.

EXAMPLE 17

A lubricity-imparting unit 201-6 with the structure as shown in FIG. 10 was fabricated by using an elastic structure made of a fluoroplastic tape ("Teflon soft tape (PTFE)" (Trademark) made by Flon Industry Co., Ltd.) with a width of 6.5 mm, a thickness of 3.8 mm and a length of 300 mm as the elastic structure 212, a 3 mm thick urethane foam as the elastic member 213, and a 1 mm thick aluminum plate as the support base 211 to which the elastic structure 212 was attached through the elastic member 213, using a double-coated adhesive tape, in such a manner that the elastic structure 212 could be brought into contact with a 2 to 3 mm wide contact width with the surface of the photoconductor.

For evaluating the lubricity-imparting effect of the thus fabricated lubricity-imparting unit 201-6, the lubricity-imparting unit 201-6 was installed in the same commercially available electrophotographic copying machine ("IMAGIO MF200" (Trademark) made by Ricoh Company, Ltd.) as used in Example 1, with the above prepared photoconductor being incorporated therein, and with the lubricity-imparting unit 201-6 being set between the toner cleaning unit and the charging unit by attaching the same to the blade attachment support of the toner cleaning unit in the photoconductor unit of the electrophotographic copying machine, using a spring, as shown in FIG. 16 in such a posture so as to apply a contact pressure to the surface of the photoconductor in the lengthwise direction thereof as desired.

Thus, the lubricity-imparting unit 201-6 was then evaluated with respect to the same evaluation items in the same manner as in Example 1. The results are shown in TABLE 1.

The results indicate that the lubricity-imparting unit 201-6 fabricated in this Example exhibited the desired lubricity-imparting effect sufficiently and had no particular problems except that slight streaks appeared in the images due to a slight problem with respect to the contacting performance of the lubricity-imparting unit 201-6 with the surface of the photoconductor.

EXAMPLE 18

A lubricity-imparting unit 201-6 with a similar structure to that shown in FIG. 10 was fabricated by using an elastic structure made of a fluoroplastic tape ("Teflon soft tape (PTFE, TK-9 Type)" (Trademark) made by Flon Industry Co., Ltd.) with a width of 6.5 mm, a thickness of 4.5 mm and a length of 300 mm as the elastic structure 212 which was attached to an L-shaped aluminum plate with a thickness of 1 mm, serving as the support base 211, using a double-coated adhesive tape ("#442J" made by Sumitomo 3M Limited).

For evaluating the lubricity-imparting effect of the thus fabricated lubricity-imparting unit 201-6, the lubricity-imparting unit 201-6 was installed in the same commercially available electrophotographic copying machine ("IMAGIO MF200" (Trademark) made by Ricoh Company, Ltd.) as used in Example 1, with the above prepared photoconductor being incorporated therein, and with the lubricity-imparting unit 201-6 being set between the toner cleaning unit and the charging unit by attaching the same to the blade attachment support of the toner cleaning unit in the photoconductor unit of the electrophotographic copying machine, using a spring and a screw for fixing the lubricity-imparting unit 201-6 as shown in FIX. 16 in such a posture so as to obtain a nip of about 1.5 mm between the elastic structure 212 and the surface of the photoconductor and also to apply a contact pressure of about 43 to 48 g to the surface of the photoconductor.

Thus, the lubricity-imparting unit 201-6 was then evaluated with respect to the same evaluation items in the same manner as in Example 1. The results are shown in TABLE 1.

The results indicate that the lubricity-imparting unit 201-6 fabricated in this Example exhibited the desired lubricity-imparting effect sufficiently and had no particular problems except that slight streaks appeared in the images.

Comparative Example 1

The same image formation procedure as in Example 1 was conducted, using the same photoconductor in the same electrophotographic copying machine as used in Example 1, except that the lubricity-imparting unit 201-2 was eliminated from the electrophotographic copying machine in order to evaluate the image quality obtained, the changes in the coefficient of friction of the surface of the photoconductor and the abrasion of the surface of the photoconductor.

Figure 20:
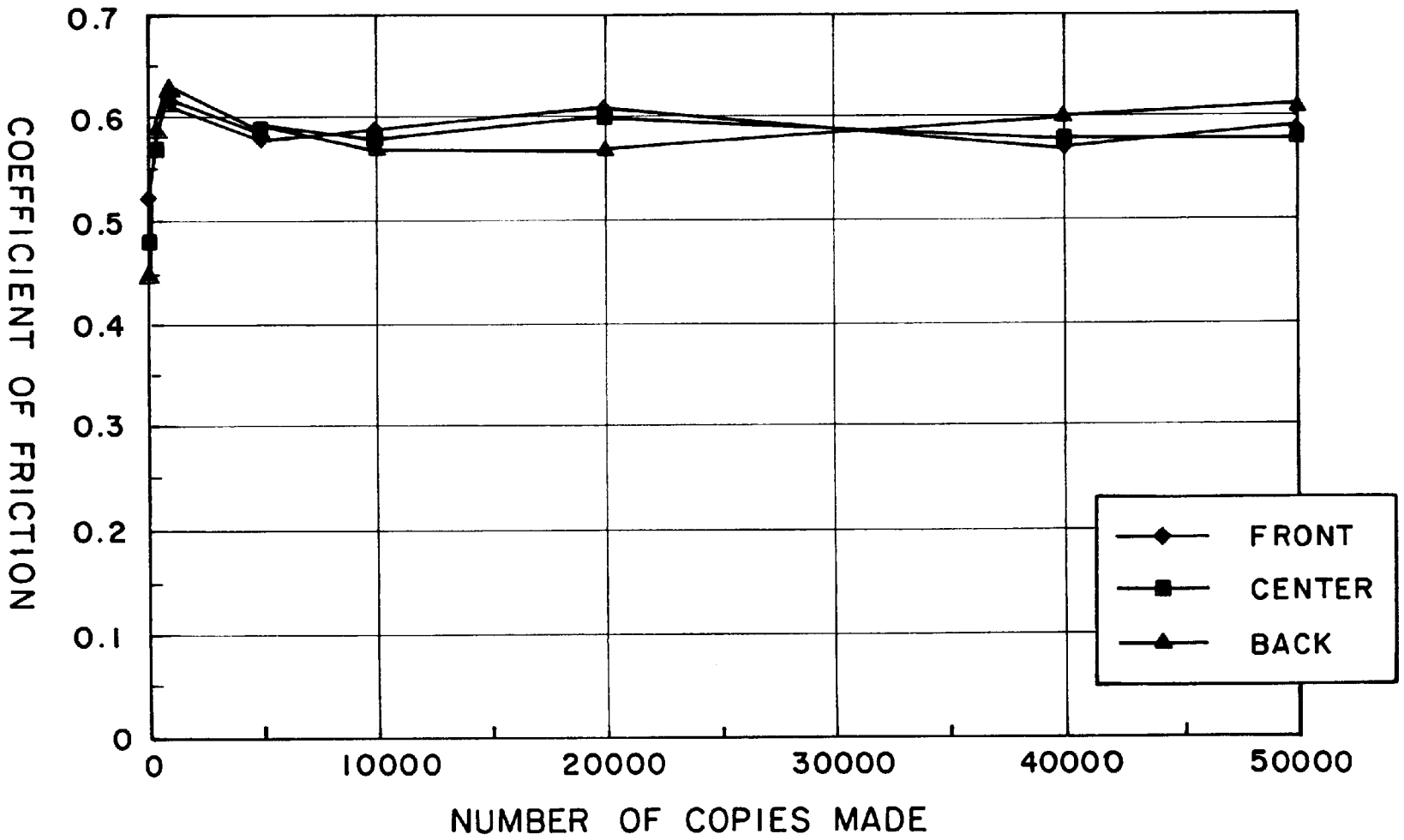
FIG. 20 is a graph showing the changes in the coefficient of friction of the surface of the photoconductor with the increase in the number of copies made in Comparative Example 1.

The results are shown in TABLE 1. The changes in the coefficient of friction of the surface of the photoconductor in the course of making copies are shown in the graph in FIG. 20. As shown in the graph, the coefficient of friction of the surface of the photoconductor increased immediately after the initiation of the copy making operation.

During this evaluation tests, there were no particular problems with the formation of images. However, the abrasion of the surface of the photoconductor was as much as 0.6 μm, which was approximately 3 times that in the case where the lubricity-imparting unit of the present invention was used, indicating that the durability of the photoconductor was considerably decreased by the elimination of the lubricity-imparting unit of the present invention.

Comparative Example 2

The same image formation procedure as in Example 1 was conducted using the same photoconductor as used in Example 1 except that its diameter was increased to 100 mm, in a commercially available electrophotographic copying machine ("DA355" (Trademark) made by Ricoh Company, Ltd.) and that instead of using the lubricity-imparting unit 201-2, the cleaning unit of the electrophotographic copying machine was modified so as to apply zinc stearate to the surface of the photoconductor through a cleaning brush, whereby the same evaluations as mentioned above were conducted.

The results are shown in TABLE 1, indicating that there was almost no abrasion in the surface of the photoconductor, but image flow was observed.

EXAMPLES 19 TO 24

The lubricity-imparting unit 101-5 fabricated in Example 11 was installed in the same electrophotographic copying machine as that employed in Example 11, using the same L-shaped angle as that employed in Example 11 for fixing the lubricity-imparting unit 101-5 in the same manner as in Example It except that a spring for adjusting the contact pressure of the flexible lubricating material **201*b*-3** to the surface of the photoconductor was also used and that the contact pressure was changed in such a manner that the coefficient of friction of the photoconductor was adjusted to be in a range of 0.58 to 0.62, in a range of 0.45 to 0.55, in a range of 0.35 to 0.45, in a range of 0.25 to 0.35, in a range of 0.15 to 0.25, and in a range of 0.2 or less after making 10,000 copies, which are respectively referred to as Example 19, Example 20, Example 21, Example 22, Example 23 and Example 24.

For evaluating the lubricity-imparting effect of the thus fabricated lubricity-imparting unit 201-5, the same evaluation tests as in Example 1 were conducted by making 50,000 copies in these Examples. The results are shown in TABLE 2.

When the coefficient of friction of the surface of the photoconductor is changed, the abrasion of the photocon-

TABLE 1

| | Flexible lubricating material | Elastic member | Lining material | Number of copies made | Resolution (lines/mm) Initial | Resolution (lines/mm) After running | Image quality | Coefficient of friction Initial | Coefficient of friction After running | Abrasion of photoconductive layer (μm/10,000 copies) |
|---|---|---|---|---|---|---|---|---|---|---|
| Ex. 1 | 200 μm PTFE | None | None | 50,000 | 5.6 | 5.6 | NP | 0.42 | 0.28 | 0.24 |
| Ex. 2 | 500 μm PTFE | None | None | 50,000 | 5.6 | 5.0 | SS | 0.51 | 0.32 | 0.22 |
| Ex. 3 | 50 μm PTFE | None | None | 50,000 | 6.3 | 5.0 | SS | 0.46 | 0.32 | 0.18 |
| Ex. 4 | 100 μm PTFE | None | None | 50,000 | 5.0 | 5.0 | NP | 0.43 | 0.28 | 0.15 |
| Ex. 5 | 200 μm PTFE | None | None | 100,000 | 5.6 | 6.3 | NP | 0.43 | 0.25 | 0.21 |
| Ex. 6 | 50 μm PTFE | Artificial leather | None | 100,000 | 5.0 | 5.6 | SS | 0.50 | 0.23 | 0.23 |
| Ex. 7 | 100 μm PTFE | Artificial leather | None | 100,000 | 6.3 | 5.6 | NP | 0.48 | 0.25 | 0.18 |
| Ex. 8 | 50 μm PTFE | Urethane foam | None | 100,000 | 5.6 | 5.0 | NP | 0.42 | 0.22 | 0.12 |
| Ex. 9 | 100 μm PTFE | Urethane foam | None | 100,000 | 5.6 | 6.3 | NP | 0.54 | 0.18 | 0.15 |
| Ex. 10 | 50 μm PTFE | Urethane foam | None | 100,000 | 5.6 | 5.6 | BS | 0.48 | 0.31 | 0.09 |
| Ex. 11 | 100 μm PTFE | Urethane foam | None | 100,000 | 5.6 | 5.0 | NP | 0.48 | 0.22 | 0.10 |
| Ex. 12 | 50 μm PTFE | Urehtane foam | PET | 100,000 | 5.0 | 5.6 | NP | 0.48 | 0.25 | 0.30 |
| Ex. 13 | 100 μm PTFE | Urethane foam | PET | 100,000 | 6.3 | 5.0 | NP | 0.48 | 0.26 | 0.15 |
| Ex. 14 | 50 μm PTFE | Urethane foam | Acetate film | 100,000 | 5.0 | 5.0 | NP | 0.48 | 0.21 | 0.21 |
| Ex. 15 | 50 μm PTFE | Urethane foam | Acetate film | 100,000 | 6.3 | 5.6 | NP | 0.48 | 0.35 | 0.26 |
| Ex. 16 | 100 μm PTFE | Urethane foam | None | 100,000 | 5.0 | 5.6 | NP | 0.48 | 0.21 | 0.12 |
| Ex. 17 | Elastic structure | Urethane foam | None | 50,000 | 5.0 | 5.0 | SS | 0.48 | 0.32 | 0.12 |
| Ex. 18 | Elastic structure | None | None | 50,000 | 6.3 | 5.0 | SS | 0.43 | 0.27 | 0.11 |
| Comp. Ex. 1 | None | None | None | 50,000 | 5.6 | 5.0 | NP | 0.48 | 0.62 | 0.60 |
| Comp. Ex. 2 | Zinc stearate | None | None | 100,000 | 5.6 | 2.0 or less | Image flow | 0.48 | 0.12 | 0.01 |

Note: NP: No problems, SS: Slight streaks, BS: Black streaks ductive layer of the photoconductor is also changed. However, when the contact pressure of the flexible lubricating material 201*b*-3 applied to the surface of the photoconductor is excessively increased, the surface of the photoconductor is disadvantageously scratched during the sliding contact of the flexible lubricating material 201*b*-3 with the surface of the photoconductor.

The evaluation tests conducted by making 50,000 copies indicate that the abrasion of the photoconductor was deceased as the coefficient of friction of the surface of the photoconductor was decreased. When it is assumed that 200,000 copies are made by using one photoconductor, the intensity of an electric field applied to the photoconductor is increased as the thickness of the photoconductive layer thereof is decreased, so that when a photoconductor comprising a thin charge transport layer is used, the photoconductor has the risk that the photoconductor will be subjected to a phenomenon called "discharge breakdown". In view of the reduction in the thickness of the photoconductive layer, the smaller the coefficient of friction of the photoconductor, the better. However, there is the risk that the surface of the photoconductor is scratched by increasing the contact pressure. Therefore, in view of the above tested ranges, the upper limit of the coefficient of friction is in the range of 0.35 to 0.45. It is preferable that the coefficient of friction be in the range of 0.25 to 0.35. However, when the coefficient of friction was decreased to 0.2, the contact pressure was about 100 gr, so that the surface of the photoconductor was scratched. These results indicate that it is preferable that the coefficient of friction be in a range of 0.2 to 0.4.

TABLE 2

| | Targeted range of coefficient of friction | Resolution (lines/mm) Initial | Resolution (lines/mm) After running | Image quality | Coefficient of friction Initial | Coefficient of friction After running | Abrasion of photoconductive layer (μm/10,000 copies) |
|---|---|---|---|---|---|---|---|
| Ex. 19 | 0.58–0.62 | 5.6 | 5.6 | No problems | 0.42 | 0.59 | 0.61 |
| Ex. 20 | 0.45–0.55 | 5.6 | 5.0 | No problems | 0.51 | 0.51 | 0.48 |
| Ex. 21 | 0.35–0.45 | 6.3 | 5.0 | No problems | 0.46 | 0.38 | 0.37 |
| Ex. 22 | 0.25–0.35 | 5.0 | 5.0 | No problems | 0.43 | 0.28 | 0.25 |
| Ex. 23 | 0.15–0.25 | 5.6 | 6.3 | No problems | 0.43 | 0.24 | 0.15 |
| Ex. 24 | 0.2 or less | 5.0 | 5.6 | Scratches & slight blur | 0.50 | 0.17 | 0.05 |

Note)
NP: No problems

EXAMPLES 25 TO 30

A lubricity-imparting unit 201-5 with the structure as shown in FIG. 8 was fabricated by using a fluoroplastic film (polytetraluoroethylene resin (PTFE), "NAFLON PTFE TAPE (TOMBO9001)(Trademark), made by Nichias Corporation) with a thickness of 100 μm as the flexible lubricating material 201*b*-3, 1.5 mm to 3 mm thick urethane foams ("PORON LE-20" and "PORON LE-24" (Trademark), made by INOAC CORPORATION) as the elastic materials 201*c*-1, a 250 μm thick polyethylene terephthalate film ("Lumirror" (Trademark) made by Toray Industries, Inc.) as the support base 201*a*-1, and a 250 μm thick polyethylene terephthalate film ("Lumirror" (Trademark) made by Toray Industries, Inc.) as the holding plate 201*d*-1 in such a manner that the flexible lubricating material 201*b*-3 exhibits different elasticities in contact with the surface of the photoconductor.

The thus fabricated lubricity-imparting unit 201-5 was attached to the photoconductor unit as shown in FIG. 15, and the contact pressure of the lubricity-imparting unit 201-5 applied to the photoconductor was adjusted in a range of 45 to 65 gr.

30,000 copies were made with a nip between the flexible lubricating material 201*b*-3 and the surface of the photoconductor changed to about 0.12 mm, 0.3 mm, 0.8 mm, 1.2 mm, 2.0 mm, and 3.0 mm, which were respectively referred to as Example 25, Example 26, Example 27, Example 28, Example 29 and Example 30, whereby the lubricity-imparting unit 201-5 was evaluated with respect to the same evaluation items in the same manner as in Example 1.

The results are shown in TABLE 3. The results indicate that when the nip was 0.12 mm, there was observed no effect of decreasing the coefficient of friction, rather the coefficient of friction was increased. However, when the nip was 0.3 mm, a reduction in the coefficient of friction was clearly observed, and when the nip was 0.8 mm or more, the coefficient of friction was reduced to 0.3 or less, and the abrasion of the photoconductor can be significantly controlled.

The image quality obtained was not affected even when the copying was carried out at 30° C., 90%RH. However, when the nip was 3.5 mm, there was a tendency that the occurrence of toner filming was slightly increased. However, there was substantially no problem even in this case.

Comparative Example 3

A lubricity-imparting unit 201-5 with the same structure as shown in FIG. 8 was fabricated in the same manner as in Example 25 except that the elastic materials 201*c*-1 employed in Example 25 were replaced by a commercially available heat-shrinkable tubing ("SUMITUBE" made by Sumitomo Electric Industries, Ltd.) with an outer diameter of about 2 mm, and was subjected to the same evaluation test as in Example 25.

In this case, however, the nip secured by the lubricity-imparting unit 201-5 fabricated in this Example was as small as 0.1 mm or less, so that the contact was substantially a line contact.

The result was that there was almost no reduction in the coefficient of friction of the surface of the photoconductor, and the abrasion of the surface of the photoconductor was considerable and streaks appeared in the images obtained.

As mentioned above, most of brand-new photoconductors usually have high coefficient of friction, so that when an image formation apparatus with such a photoconductor being incorporated therein is initially operated without taking any step for decreasing the coefficient of friction of the photoconductor before use, it may occur that initial driving the photoconductor in rotation cannot be smoothly carried out.

In order to prevent such a problem from occurring and also to initiating the driving of the photoconductor in rotation without the surface thereof being scratched, it is effective to apply a lubricant to a top end portion or the periphery of the cleaning blade, or to a portion of the surface of the photoconductor near the cleaning blade before initiating the operation of the image formation apparatus. It is preferable to use such a lubricant and the lubricity-imparting unit of the present invention in combination.

This will now be explained in more detail with reference to the following Examples 31 and 32:

TABLE 3

| | Nip (mm) | Resolution (lines/mm) Initial | After running | 30° C./ 90% RH | Image quality After running | 30° C./ 90% RH | Coefficient of friction Initial | After running | Abrasion of photo-conductive layer (μm) |
|---|---|---|---|---|---|---|---|---|---|
| Ex. 25 | 0.12 | 6.3 | 6.3 | 5.6 | No problems | No problems | 0.48 | 0.59 | 1.40 |
| Ex. 26 | 0.3 | 5.6 | 5.6 | 5.6 | No problems | No problems | 0.45 | 0.31 | 0.60 |
| Ex. 27 | 0.8 | 7.1 | 6.3 | 5.0 | No problems | No problems | 0.42 | 0.23 | 0.30 |
| Ex. 28 | 1.2 | 5.6 | 5.6 | 6.3 | No problems | No problems | 0.47 | 0.18 | 0.19 |
| Ex. 29 | 2.0 | 6.3 | 5.6 | 5.6 | No problems | No problems | 0.50 | 0.15 | 0.14 |
| Ex. 30 | 3.5 | 6.3 | 6.3 | 4.5 | No problems | Slightly uneven | 0.49 | 0.17 | 0.15 |
| Comp. Ex. 3 | 0.1 or less | 6.3 | 5 | 5 | Streak pattern | Streak pattern | 0.48 | 0.58 | 1.90 |

EXAMPLE 31-1

A powder-like polyvinylidene fluoride with a particle size of 0.3 to 0.5 μm was deposited on a brush. By use of the polyvinylidene-fluoride deposited brush, the polyvinylidene fluoride was applied to a top portion of a cleaning blade of the cleaning unit 106 and to a portion of the surface of the photoconductor 101 around the cleaning blade as shown in FIG. 17, with the photoconductor 101 was manually rotated.

A lubricity-imparting unit 201-7 with the structure as shown in FIG. 3 was fabricated by using a fluoro-plastic film (polytetraluoroethylene resin (PTFE), "NAFLON PTFE TAPE (TOMBO9001) (Trademark), made by Nichias Corporation) with a thickness of 100 μm as the flexible lubricating material 201*b*-4, a 2 mm thick urethane foam ("PORON LE-20" (Trademark), made by INOAC CORPORATION) as the elastic material 201*c*-2, a 250 μm thick polyethylene terephthalate film ("Lumirror" (Trademark) made by Toray Industries, Inc.) as the support base 201*a*-2, and a 250 μm thick polyethylene terephthalate film ("Lumirror" (Trademark) made by Toray Industries, Inc.) as the holding plate 201*d*-2.

The thus fabricated lubricity-imparting unit 201-7 was attached to the photoconductor unit as shown in FIG. 3 and FIG. 17, with a nip of 0.8 to 1.1 mm, and with the contact pressure of the lubricity-imparting unit 201-7 applied to the photoconductor being set in a range of 55±2 gr.

20,000 copies were made under the above-mentioned conditions, whereby the lubricity-imparting unit 201-7 was evaluated with respect to the items specified in TABLE 4.

The result was that the initial driving rotation of the photoconductor was smooth, and that the lubricity-imparting unit 201-7 disposed between the cleaning unit 106 and the charging unit 102 as shown in FIG. 17 worked properly, without any substantial abrasion of the surface of the photoconductor 101. Thus, there were no problems for use in practice in this system.

EXAMPLE 31-2

Using the same lubricity-imparting unit 201-7 as that employed in Example 31-1, the same evaluation test as in Example 31-1 was conducted except that the powder-like polyvinylidene fluoride employed in Example 31-1 was replaced by a powder-like polytetrafluoro-ethylene (PTFE "L-2 DAIKIN-POLYFLON PTFE Low-Polymer" (Trademark), made by Daikin Industries, Ltd.).

The results were the same as in Example 31-1, indicating that the powder-like polytetrafluoroethylene employed in this Example properly worked in the same manner as the powder-like polyvinylidene fluoride employed in Example 31-1. Thus, there were no problems for use in practice in this system as shown in TABLE 4.

TABLE 4

| | Powder lubricant | Resolution (lines/mm) Front | Back | Coefficient of friction Front | Back | Abrasion of photo-conductive layer (μm) | Locking | Blade's weeping | Image quality |
|---|---|---|---|---|---|---|---|---|---|
| Ex. 31-1 | PVDF | 6.3 | 5.6 | 0.47 | 0.24 | 0.09 | None | None | No problems |

TABLE 4-continued

| | Powder lubricant | Resolution (lines/mm) Front | Resolution (lines/mm) Back | Coefficient of friction Front | Coefficient of friction Back | Abrasion of photo-conductive layer (μm) | Locking | Blade's weeping | Image quality |
|---|---|---|---|---|---|---|---|---|---|
| Ex. 31-2 | PTFE | 5.6 | 5.0 | 0.43 | 0.23 | 0.11 | None | None | No problems |

EXAMPLE 32-1

A commercially available unwoven fabric ("MICROWIPE MU-1000" (Trademark) made by Uni-Charm Corporation) was impregnated with a commercially available silicone oil ("(V) 300CS Silicone Oil (KF96)" (Trademark) made by Shin-Etsu Chemical Co., Ltd.) or the silicone oil was deposited on the unwoven fabric.

By use of the silicone oil containing unwoven fabric, the silicone oil was applied to a cleaning blade of the cleaning unit 106 in its entirety as shown in FIG. 17, and an excessive silicone oil applied thereto was wiped oft using the above unwoven fabric free of the silicone oil. The photoconductor 101 was then manually rotated two or three times.

A lubricity-imparting unit 201-7 with the structure as shown in FIG. 3 was fabricated by using a fluoroplastic film (polytetraluoroethylene resin (PTFE), "NAFLON PTFE TAPE (TOMBO9001) (Trademark), made by Nichias Corporation) with a thickness of 100 μm as the flexible lubricating material **201*b*-4, a 2 mm thick urethane foam ("PORON LE-20" (Trademark), made by INOAC CORPORATION) as the elastic material 201*c*-1, a 250 μm thick polyethylene tere-phthalate film ("Lumirror" (Trademark) made by Toray Industries, Inc.) as the support base 201*a*-2, and a 250 μm thick polyethylene terephthalate film ("Lumirror" (Trademark) made by Toray Industries, Inc.) as the holding plate 201*d*-2**.

The thus fabricated lubricity-imparting unit 201-7 was attached to the photoconductor unit as shown in FIG. 3 and FIG. 17, with a nip of about 0.8 mm, and with the contact pressure of the lubricity-imparting unit 201-7 applied to the photoconductor being set in a range of 55±2 gr.

20,000 copies were made under the above-mentioned conditions, whereby the lubricity-imparting unit 201-7 was evaluated with respect to the items specified in TABLE 5.

EXAMPLE 32-2

Using the same lubricity-imparting unit 201-7 as that employed in Example 32-1, the same evaluation test as in Example 32-1 was conducted in the same manner as in Example 32-1 except that the silicone oil ("(V) 300CS Silicone Oil (KF96)" (Trademark) made by Shin-Etsu Chemical Co., Ltd.) employed in Example 32-1 was replaced by a commercially available fluorine-containing oil ("(IX) 100CS Fluorine-containing Oil (FLS507)" (Trademark), made by Asahi Chemical Industry Co., Ltd.).

The results were the same as in Example 32-1, indicating that the fluorine-containing oil employed in this Example properly worked in the same manner as the silicone oil employed in Example 32-1. Thus, there were no problems for use in practice in this system as shown in TABLE 5.

EXAMPLE 32-3

Using the same lubricity-imparting unit 201-7 as that employed in Example 32-1, the same evaluation test as in Example 32-1 was conducted in the same manner as in Example 32-1 except that the silicone oil ("(V) 300CS Silicone Oil (KF96)" (Trademark) made by Shin-Etsu Chemical Co., Ltd.) employed in Example 32-1 was replaced by a commercially available grease ("SH111" (Trademark), made by Dow Corning Toray Silicone Co., Ltd.).

The results were the same as in Example 32-1, indicating that the grease employed in this Example properly worked in the same manner as the silicone oil employed in Example 32-1. Thus, there were no problems for use in practice in this system as shown in TABLE 5.

TABLE 5

| | Liquid lubricant Type | Liquid lubricant Trademark | Viscosity (CS) | Resolution (lines/mm) Front | Resolution (lines/mm) Back | Coefficient of friction Front | Coefficient of friction Back | Abrasion of photo-conductive layer (μm) | Locking | Blade's weeping | Image quality |
|---|---|---|---|---|---|---|---|---|---|---|---|
| Ex. 32-1 | Si oil | KF96 | 300 | 6.3 | 5.6 | 0.52 | 0.26 | 0.09 | None | None | No problems |
| Ex. 32-2 | F oil | FLS507 | 100 | 5.6 | 5.6 | 0.51 | 0.22 | 0.15 | None | None | No problems |
| Ex. 32-3 | Greece | SH111 | — | 6.3 | 5.0 | 0.53 | 0.25 | 0.18 | None | None | No problems |

The result was that the initial driving rotation of the photoconductor was smooth, and that the lubricity-imparting unit 201-7 disposed between the cleaning unit 106 and the charging unit 102 as shown in FIG. 17 worked properly, without any substantial abrasion of the surface of the photoconductor 101. Thus, there were no problems for use in practice in this system.

EXAMPLES 33-1 TO 33-4

Figure 24:
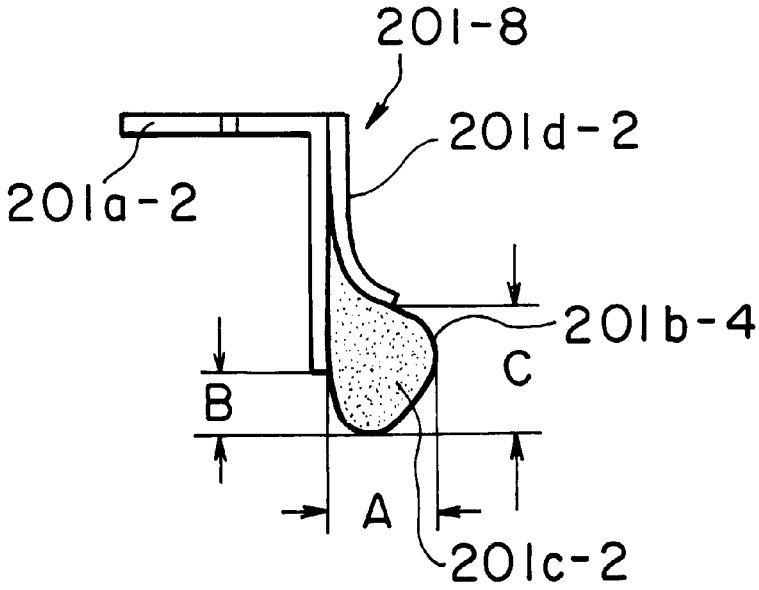
FIG. 24 is a schematic cross-sectional view of a further example of a lubricity-imparting unit of the present invention for use with an auxiliary cleaning unit.

A lubricity-imparting unit 201-8 with the structure as shown in FIG. 24 was fabricated by using a fluoroplastic plastic film (polytetraluoroethylene resin (PTFE), "NAFLON PTFE TAPE (TOMBO9001)(Trademark), made by Nichias Corporation) with a thickness of 100 μm as the flexible lubricating material **201*b*-4, a 2 mm thick urethane foam ("PORON LE-20" (Trademark), made by INOAC CORPORATION) as the elastic material 201***c*-2, a 250 μm thick polyethylene terephthalate film ("Lumirror" (Trademark) made by Toray Industries, Inc.) as the support base 201*a*-2, and a 250 μm thick polyethylene terephthalate film ("Lumirror" (Trademark) made by Toray Industries, Inc.) as the holding plate 201*d*-2 in such a fashion that a size A was set at about 4.2 mm, a size B was set at about 4.5 mm, and a size C was set at about 5 mm as shown in FIG. 24. The above-mentioned lubricity-imparting unit 201-8 is referred to as part 1.

Four rubber plates with a thickness of 1 mm, a width of 10 mm and a length of 285 mm, were then prepared, using a 1 mm thick silicone rubber plate with a rubber hardness of 40 degree, a 1 mm thick chloroprene rubber with a rubber hardness of 55 degree, a 1 mm thick polyurethane rubber with a rubber hardness of 70 degree, and a 1 mm thick polyurethane rubber with a rubber hardness of 80 degree, respectively, and these rubber plates were respectively bonded to an L-shaped aluminum plate with a thickness of 0.3 mm which served as a support base for each of the rubber plates, using a double-coated adhesive tape in such a fashion that there was a size difference of 3.5 mm between a top end portion of each of the above rubber plates and a top end portion of the L-shaped aluminum plate, whereby four rubber-plate bonded aluminum supports, which are respectively referred to parts 2-1, 2-2, 2-3 and 2-4, were fabricated.

The above-mentioned part 1 and each of the parts 2-1 to 2-4 were combined integrally, whereby four integrated parts were fabricated.

Each of the four integrated parts was incorporated in a photoconductor unit of a commercially available electrophotographic copying machine ("MF 200" (Trademark) made by Ricoh Co., Ltd.).in such a manner that the distance between a toner cleaning blade of the photoconductor unit and the part 1 of each integrated part was set at 1.5 mm, with each of the parts 2-1 to 2-4 being fixed using a screw, and that the nip between the surface of the photoconductor and the above-mentioned lubricity-imparting unit 201-8 which is referred to as part 1 was set in the range of 0.7 to 1.0 mm, and the contact pressure thereof was also set in a range of 30 to 35 g, by adjusting the fixing by the screw.

Thus, the lubricity-imparting unit 201-8 was then evaluated with respect to the same evaluation items in the same manner as in Example 1.

The results are shown in TABLE 6. The results indicate that (1) when the silicone rubber plate with a rubber hardness of 40 degree was used as in part 2-1, toner deposition on the lubricity-imparting unit 201-8 was observed because the toner which passed through the cleaning blade could not be caught completely, so that there was a slight problem in the image quality obtained and a slight abrasion was observed in the photoconductive layer of the photoconductor, (2) when the chloroprene rubber plate with a rubber hardness of 55 degree was used as in part 2-2, there were no substantial problems although slight streaks appeared in the images obtained, and (3) when the polyurethane rubber plates with a hardness of 70 degree and a hardness of 85 degree were used as in parts 2-3 and 2-4, almost all foreign materials such as toner particles could be caught, so that no adverse effects on the image and the photoconductor were observed.

TABLE 6

| | Material for auxiliary cleaning member | Resolution (lines/mm) | | | Image quality | | Coefficient of friction | | Abrasion of photo-conductive layer |
|---|---|---|---|---|---|---|---|---|---|
| | | Initial | After running | 30° C./ 90% RH | After running | 30° C./ 90% RH | Initial | After running | (μm/10,000 copies) |
| Ex. 33-1 | Silicone rubber (Hardness: 40 degree) | 5.6 | 5.6 | 5.0 | G | BS (1 to 2 lines) | 0.44 | 0.33 | 0.26 |
| Ex. 33-2 | Chloroprene rubber (Hardness: 55 degree) | 6.3 | 5.6 | 5.0 | G | BS (Slight) | 0.5 | 0.28 | 0.13 |
| Ex. 33-3 | Polyurethane (Hardness: 70 degree) | 5.6 | 6.3 | 5.6 | G | G | 0.48 | 0.25 | 0.10 |
| Ex. 33-4 | Polyurethane (Hardness: 85 degree) | 5.6 | 6.3 | 5.6 | G | G | 0.51 | 0.22 | 0.009 |

Note) G: Good, BS: Black streaks

Japanese Patent Application No. 10-336465 filed Nov. 12, 1998, Japanese Patent Application No. 10-348284 filed Dec. 8, 1998, and Japanese Patent Application No. 10-352870 filed Dec. 11, 1998, are hereby incorporated by reference.

What is claimed is:

1. A lubricity-imparting unit which imparts lubricity to a surface of an electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, wherein said flexible lubricating material is a film-shaped material comprising a lubricating agent.

2. The lubricity-imparting unit as claimed in claim 1, further comprising an elastic member which is built in said flexible lubricating material.

3. The lubricity-imparting unit as claimed in claim 1, wherein said flexible lubricating material comprises a fluoroplastic.

4. The lubricity-imparting unit as claimed in claim 1, wherein said flexible lubricating material has a thickness of 50 to 500 μm.

5. The lubricity-imparting unit as claimed in claim 1, further comprising an elastic member which is built in said lubricity-imparting unit, with said lubricity-imparting unit having such a structure that is fixed to a support, optionally with said lubricity-imparting unit further being held between said support and a holding plate.

6. A lubricity-imparting unit which imparts lubricity to a surface of an electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, wherein a portion of said flexible lubricating material, which comes into contact with the surface of said electrophotographic photoconductor, is lined with a liner.

7. A lubricity-imparting unit which imparts lubricity to a surface of an electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, wherein a portion of said flexible lubricating material, which comes into contact with the surface of said electrophotographic photoconductor, is marked at an inside of said portion with a marker for judging an abraded state of said flexible lubricating material.

8. An electrophotographic image formation apparatus comprising (a) an electrophotographic photoconductor, (b) a charging unit, (c) an exposure unit, (d) a development unit, an image transfer unit and (e) a cleaning unit which are disposed around said electrophotographic photoconductor, and (f) a lubricity-imparting unit which imparts lubricity to a surface of said electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, wherein said flexible lubricating material is a film-shaped material comprising a lubricating agent.

9. The electrophotographic image formation apparatus as claimed in claim 8, further comprising an elastic member which is built in said flexible lubricating material.

10. The electrophotographic image formation apparatus as claimed in claim 8, wherein said flexible lubricating material comprises a fluoroplastic.

11. The electrophotographic image formation apparatus as claimed in claim 8, wherein said flexible lubricating material has a thickness of 50 to 500 $\mu$m.

12. The electrophotographic image formation apparatus as claimed in claim 8, further comprising an elastic member which is built in said lubricity-imparting unit, with said lubricity-imparting unit having such a structure that is fixed to a support, optionally with said lubricity-imparting unit further being held between said support and a holding plate.

13. An electrophotographic image formation apparatus comprising (a) an electrophotographic photoconductor, (b) a charging unit, (c) an exposure unit, (d) a development unit, an image transfer unit and (e) a cleaning unit which are disposed around said electrophotographic photoconductor, and (f) a lubricity-imparting unit which imparts lubricity to a surface of said electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, wherein a portion of said flexible lubricating material, which comes into contact with the surface of said electrophotographic photoconductor, is lined with a liner.

14. An electrophotographic image formation apparatus comprising (a) an electrophotographic photoconductor, (b) a charging unit, (c) an exposure unit, (d) a development unit, an image transfer unit and (e) a cleaning unit which are disposed around said electrophotographic photoconductor, and (f) a lubricity-imparting unit which imparts lubricity to a surface of said electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, wherein a portion of said flexible lubricating material, which comes into contact with the surface of said electrophotographic photoconductor, is marked at an inside of said portion with a marker for judging an abraded state of said flexible lubricating material.

15. The electrophotographic image formation apparatus as claimed in claim 8, wherein said lubricity-imparting unit is disposed between said cleaning unit and said charging unit.

16. An electrophotographic image formation apparatus comprising (a) an electrophotographic photoconductor, (b) a charging unit, (c) an exposure unit, (d) a development unit, an image transfer unit and (e) a cleaning unit which are disposed around said electrophotographic photoconductor, and (f) a lubricity-imparting unit which imparts lubricity to a surface of said electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, further comprising an auxiliary cleaning unit which is disposed between said lubricity-imparting unit and said cleaning unit.

17. An image formation method of forming images, using an electrostatic image formation apparatus comprising (a) an electrophotographic photoconductor, (b) a charging unit, (c) an exposure unit, (d) a development unit, an image transfer unit and (e) a cleaning unit which are disposed around said electrophotographic photoconductor, and (f) a lubricity-imparting unit which imparts lubricity to a surface of said electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, wherein an image is formed with said lubricity-imparting unit being constantly set in contact with the surface of said electrophotographic photoconductor or being intermittently brought into contact with the surface of said electrophotographic photoconductor, wherein said lubricity-imparting unit in contact with the surface of said electrophotographic photoconductor forms a nip of 0.2 mm or more therebetween.

18. The image formation method as claimed in claim 17, wherein said cleaning unit comprises a cleaning blade for cleaning the surface of said electrophotographic photoconductor, and a lubricant is coated on at least one portion of (1) a top end portion of said cleaning blade, (2) a portion around said top end portion of said cleaning blade, or (3) a portion of the surface of said electrophotographic photoconductor near said cleaning blade, before said electrophotographic image formation apparatus is initiated to be brought into operation for forming said image.

19. An image formation method of forming images, using an electrostatic image formation apparatus comprising (a) an electrophotographic photoconductor, (b) a charging unit, (c) an exposure unit, (d) a development unit, an image transfer unit and (e) a cleaning unit which are disposed around said electrophotographic photoconductor, and (f) a lubricity-imparting unit which imparts lubricity to a surface of said electrophotographic photoconductor by being disposed in contact with the surface of said electrophotographic photoconductor, at least a surface of said lubricity-imparting unit which comes into contact with the surface of said electrophotographic photoconductor comprising a flexible lubricating material and having a length at least capable of covering an image formation region of said electrophotographic photoconductor lengthwise, wherein an image is formed with said lubricity-imparting unit being constantly set in contact with the surface of said electrophotographic photoconductor or being intermittently brought into contact with the surface of said electrophotographic photoconductor, wherein the surface of said electrophotographic photoconductor has a coefficient of friction of 0.4 or less when said lubricity-imparting unit comes into contact with the surface of said electrophotographic photoconductor or after said image has been formed.

20. The image formation method as claimed in claim 19, wherein said cleaning unit comprises a cleaning blade for cleaning the surface of said electrophotographic photoconductor, and a lubricant is coated on at least one portion of (1) a top end portion of said cleaning blade, (2) a portion around said top end portion of said cleaning blade, or (3) a portion of the surface of said electrophotographic photoconductor near said cleaning blade, before said electrophotographic image formation apparatus is initiated to be brought into operation for forming said image.

* * * * *